US009649859B2

(12) United States Patent
Bitoh

(10) Patent No.: US 9,649,859 B2
(45) Date of Patent: May 16, 2017

(54) DRAWING APPARATUS AND METHOD FOR CONTROLLING DRAWING BY DRAWING APPARATUS

(71) Applicant: CASIO COMPUTER CO., LTD., Shibuya-ku, Tokyo (JP)

(72) Inventor: Hiroyasu Bitoh, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/192,972

(22) Filed: Jun. 24, 2016

(65) Prior Publication Data

US 2017/0001451 A1 Jan. 5, 2017

(30) Foreign Application Priority Data

Jun. 30, 2015 (JP) ..... 2015-130635

(51) Int. Cl.
*B41J 29/38* (2006.01)
*B41J 11/00* (2006.01)
*B41J 2/01* (2006.01)

(52) U.S. Cl.
CPC ..... *B41J 11/002* (2013.01); *B41J 2/01* (2013.01)

(58) Field of Classification Search
CPC ..... B41J 11/002; B41J 11/485; B41J 2/01
See application file for complete search history.

(56) References Cited

U.S. PATENT DOCUMENTS 6,286,517 B1 9/2001 Weber et al.
8,267,507 B2 * 9/2012 Mitsuzawa ..... B41J 2/2114 347/102
9,168,746 B2 * 10/2015 Usuda ..... B41J 2/14274

FOREIGN PATENT DOCUMENTS

JP 2003534083 A 11/2003

* cited by examiner

*Primary Examiner* — Juanita D Jackson
(74) *Attorney, Agent, or Firm* — Holtz, Holtz & Volek PC

(57) ABSTRACT drawing apparatus including a drawing head on which at least one drawing tool is mounted, the drawing tool applying a drawing on a drawing subject; and an illumination device comprising at least one light source configured to radiate light on an area of the drawing subject where the drawing is applied. The drawing tool includes a first drawing tool that applies the drawing by using a first type ink which is colorless ink or a specific color ink which has substantially the same color as the drawing subject, and a second drawing tool that applies the drawing by using a second type ink different from the first type ink. In case where the drawing on a first drawn area of the drawing subject is applied by the first drawing tool, the imaging unit acquired the subject image by imaging the first drawn area where the light radiated from the light source is specularly reflected.

20 Claims, 8 Drawing Sheets

DRAWING APPARATUS AND METHOD FOR CONTROLLING DRAWING BY DRAWING APPARATUS

CROSS-REFERENCE TO RELATED APPLICATIONS

The present invention contains subject matter related to Japanese Patent Application No. 2015-130635 filed in the Japanese Patent Office on Jun. 30, 2015, the entire contents of which are incorporated herein by reference.

BACKGROUND OF THE INVENTION

1. Field of the Invention

The present invention relates to a drawing apparatus and a method for controlling drawing by the drawing apparatus.

2. Description of the Related Art

Conventionally, nail printing apparatuses for printing desired nail designs on nails of human fingers are known. An example of such a nail printing apparatus is described in Japanese Unexamined Patent Application Publication (Translation of PCT Application) No. 2003-534083.

Nail printing can be enjoyed readily without the need to visit a nail salon or the like by such an apparatus.

Using a plotter drawing apparatus provided with a drawing tool (pen) for drawing has been considered in which a pen tip is brought into direct contact with a surface of a drawing subject.

In cases where a plotter drawing apparatus is used as the nail printing apparatus, various types of ink that have been problematic when used in ink jet apparatuses can be used. For example, high-viscosity inks, inks having pigments (colorings) of large particle size, glitter, and the like can be used.

As such, in cases where a plotter drawing apparatus is used as the nail printing apparatus, base coats (white under coat), receptive layers, top coats, and the like can be applied using the nail printing apparatus instead of via manual labor by a user; and nail printing can be realized with a finish more closely resembling the nail art performed at a nail salon or the like.

However, in cases where a plotter drawing apparatus is used as the nail printing apparatus, a drawing position of a pen on the nails must be controlled as accurately as possible in order to precisely draw delicate designs.

Additionally, a high degree of accuracy is needed for the mounting mechanism of the pen, the shape of the pen, and the like in order to accurately control the drawing position of the pen by using mechanical techniques. As such, there is a possibility that the costs of nail printing apparatuses and pens will be high.

Furthermore, it is not possible to completely eliminate problems such as manufacturing variations in the shape of the pen or the decline in the position accuracy of the pens due to aging of the moving mechanism of the pen in the nail printing apparatus. Due to these various causes, even if the pen or moving mechanism of the pen used are highly accurate, the drawing position on the nail by each pen may deviate from the intended drawing position set by the nail printing apparatus, where there is no decline in the position accuracy of the pen, variation in the shape of the pen, or the like. Consequently, there have been cases where drawing of high accuracy has not been achievable. For example, in cases where a line in a design changes color at a location along the line, there have been cases where the connections of the line at that location have deviated slightly, resulting in the distortion of the design and the like.

Additionally, in cases where the ink used is a white ink or a colorless ink, that is, for example, where a white ink is used for an under coat (foundation) and a colorless ink is used for a top coat or the like and the color of a paper is white, there is hardly any difference between the figure drawn on the paper using these inks and the color of the paper. Consequently, it is difficult to accurately detect the position of the figure drawn on the paper using these inks and it is difficult to accurately detect deviations in the drawing positions of pens using these inks.

As such, there are cases where drawing is carried out while unaware of the fact that deviations have occurred in the drawing position of the pen, which has led to cases where the drawing has overrun onto portions other than the nails, for example, the skin or the like.

BRIEF SUMMARY OF THE INVENTION

The present invention is advantageous in that a drawing apparatus and a method for controlling drawing by the drawing apparatus can be provided whereby even if the ink of the drawing tool, in a drawing apparatus that applies a drawing by using a drawing tool, is a colorless ink or a type of colored ink, the drawing position of the drawing tool can be accurately confirmed on the apparatus side and excellent drawing can be carried out.

According to an embodiment of the present invention, there is provided a first drawing apparatus including: a drawing head on which at least one drawing tool is mounted, the drawing tool applying a drawing on a drawing subject; an imaging unit which acquires a subject image by imaging the drawing subject; and an illumination device comprising at least one light source configured to radiate light on an area of the drawing subject where the drawing is applied; wherein the drawing tool includes a first drawing tool that applies the drawing by using a first type ink which is a colorless ink or a specific color ink which has substantially the same color as the drawing subject, and a second drawing tool that applies the drawing by using a second type ink which is not the colorless ink and not the specific color ink; and in a case where the drawing on a first drawn area of the drawing subject is applied by the first drawing tool, the imaging unit acquires the subject image by imaging the first drawn area where the light radiated from the light source is specularly reflected.

According to another embodiment of the present invention, there is provided a second drawing apparatus including: a drawing head on which at least one drawing tool is mounted, the drawing tool applying a drawing on a drawing subject; an imaging unit which acquires a subject image by imaging the drawing subject; and an illumination device having at least one light source configured to radiate light on an area of the drawing subject where the drawing is applied; wherein the drawing tool includes at least a specific drawing tool that applies the drawing by using a specific ink which is a colorless ink or a specific color ink which has substantially the same color as the drawing subject; and in a case where the drawing on a drawn area of the drawing subject is applied by the specific drawing tool, the imaging unit acquires the subject image by imaging the drawn area where the light radiated from the light source is specularly reflected.

According to another embodiment of the present invention, there is provided a first method for controlling drawing by a drawing apparatus, the drawing apparatus including: a drawing head on which at least one drawing tool is mounted, the drawing tool applying a drawing on a drawing subject; an imaging unit which acquires a subject image by imaging the drawing subject; and an illumination device having at least one light source configured to radiate light on an area of the drawing subject where the drawing is applied; wherein the drawing tool includes a first drawing tool that applies the drawing by using a first type ink which is a colorless ink or a specific color ink which has substantially the same color as the drawing subject, and a second drawing tool that applies the drawing by using a second type ink which is not the colorless ink and not the specific color ink; the first method for controlling drawing comprising: a step of applying the drawing on the drawing subject by using the drawing tool mounted on the drawing head; and a step of acquiring the subject image using the imaging unit by imaging the area of the drawing subject where the drawing is applied, after the drawing has been applied to the drawing subject; wherein in a case where the drawing on a first drawn area of the drawing subject is applied by the first drawing tool, the step of acquiring the subject image comprises a step of acquiring the subject image using the imaging unit by imaging the first drawn area where the light radiated from the light source is specularly reflected.

According to another embodiment of the present invention, there is provided a second method for controlling drawing by a drawing apparatus, the drawing apparatus including: a drawing head on which at least one drawing tool is mounted, the drawing tool applying a drawing on a drawing subject; an imaging unit which acquires a subject image by imaging an area of the drawing subject where the drawing is applied; and an illumination device having at least one light source configured to radiate light on an area of the drawing subject where the drawing is applied; wherein the drawing tool includes at least a specific drawing tool that applies the drawing by using a specific ink which is a colorless ink or a specific color ink which has substantially the same color as the drawing subject; the second method for controlling drawing comprising: a step of applying the drawing on a drawn area of the drawing subject by the specific drawing tool mounted on the drawing head; and a step of acquiring the subject image using the imaging unit by imaging the drawn area where the light radiated from the light source is specularly reflected.

DETAILED DESCRIPTION OF THE INVENTION

Figure 1B:
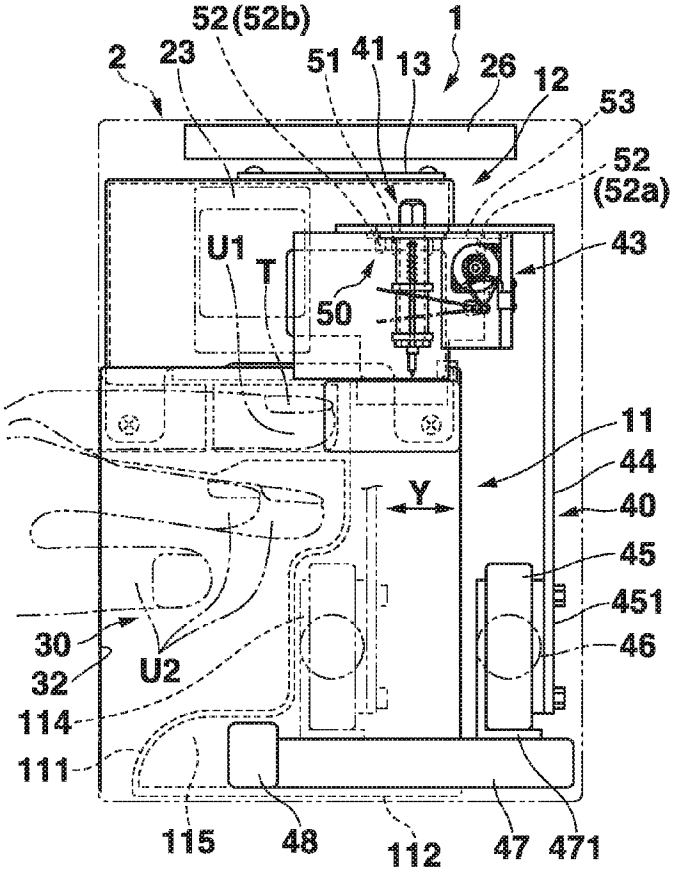
FIG. 1B is a side view illustrating the internal configuration of the drawing apparatus depicted in FIG. 1A.

Embodiments of the nail printing apparatus (drawing apparatus) and method for controlling drawing by the nail printing apparatus (drawing apparatus) according to the present invention are described below in detail while referring to the drawings.

While various limitations, which are technically preferable from the perspective of carrying out the present invention, are placed on the embodiments described below, the scope of the present invention should not be construed to be limited to these embodiments or the examples illustrated in the drawings.

In the following embodiments, a nail printing apparatus 1 will be described as an apparatus for drawing on a drawing subject surface, namely the surface of a fingernail. However, the drawing subject surface of the present invention is not limited to the surface of a fingernail and, for example, may be the surface of a toenail.

Figure 1A:
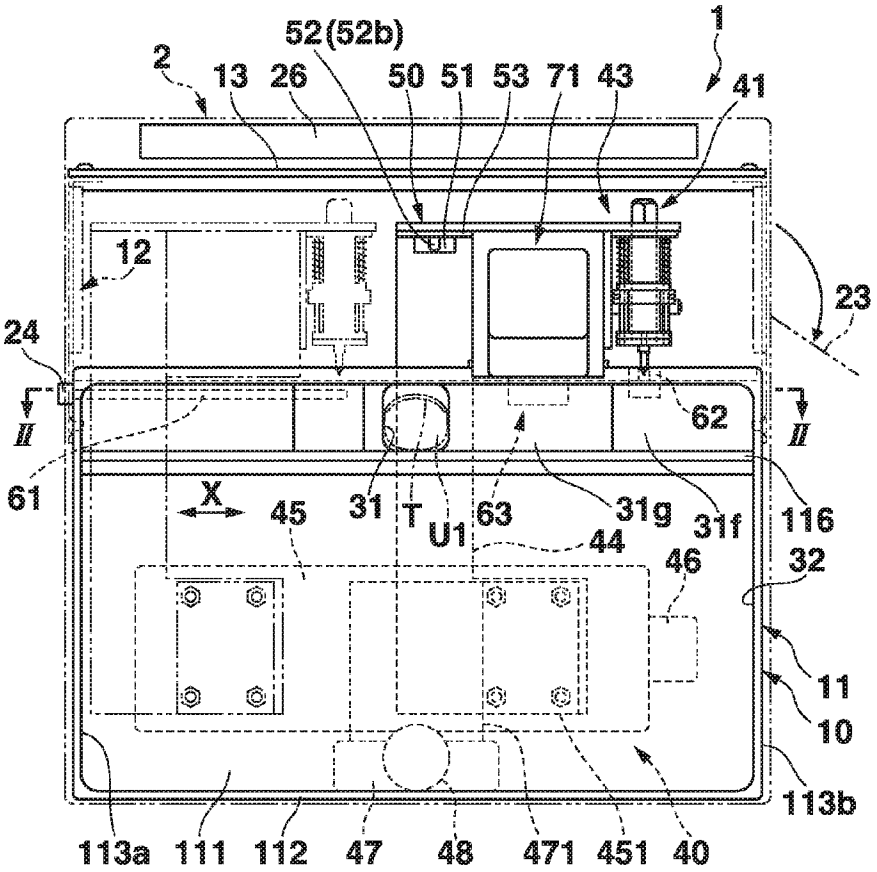
FIG. 1A is a front view of a drawing apparatus according to an embodiment of the present invention.

FIG. 1A is a front view of a nail printing apparatus, illustrating an internal configuration of the nail printing apparatus. FIG. 1B is a side view illustrating the internal configuration of the nail printing apparatus depicted in FIG. 1A.

Figure 2:
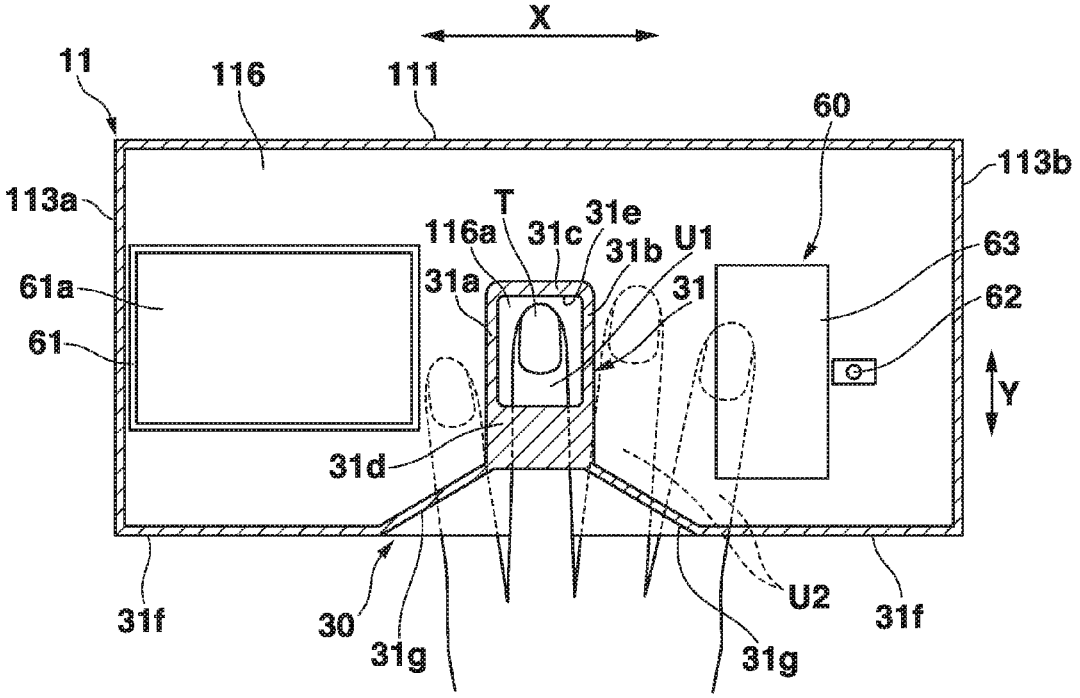
FIG. 2 is a cross-sectional view taken along line II-II of FIG. 1A.

FIG. 2 is a cross-sectional view taken along line II-II of FIG. 1A.

As illustrated in FIGS. 1A and 1B, in the nail printing apparatus 1 of the present embodiment a drawing head 43 is provided with drawing tools, namely a pen 41, and an ink jet drawing portion 71. The nail printing apparatus 1 of the present embodiment uses plotter printing and ink jet printing to apply a drawing on a nail T of a print finger U1.

The nail printing apparatus 1 is provided with a case body 2 and an apparatus main body 10 housed in the case body 2.

A cover 23, configured to be openable and closeable, for replacing the pen 41 and the ink jet drawing portion 71 of the hereinafter described drawing unit 40 is provided in an edge of an upper portion of a side surface of the case body 2.

The cover 23 is rotatable via, for example, a hinge or the like, from a closed state to an open state, as illustrated in FIG. 1A.

An operation unit 25 (see FIG. 6) is set on an upper surface (top panel) of the case body 2.

The operation unit 25 is an input unit where a user performs various types of input.

Operation buttons (not illustrated in the drawings) for performing various types of input are set in the operation unit 25. Examples of the operation buttons include a power switch button for turning on the power of the nail printing apparatus 1, a stop switch button for stopping operation, a design selection button for selecting a nail design (design image) to be drawn on the nail T, a drawing start button for commanding the drawing to start, and the like.

A display unit 26 is set approximately in a center portion of the top surface (top panel) of the case body 2.

The display unit 26 is configured from, for example, a liquid crystal display (LCD), an organic electroluminescence display, or other type of flat display.

In the present embodiment, examples of images appropriately displayed on the display unit 26 include nail images obtained by imaging the print finger U1 (finger images including images of the nail T), images of the outline or the like of the nail T included in the finger images, design selection images for selecting a nail design (specific design image) to be drawn on the nail T, thumbnail images for design confirmation, command screens displaying various commands, and the like.

Note that a configuration is possible in which a touch panel for performing various types of input is integrated into the surface of the display unit 26.

The apparatus main body 10 is formed into a rough box-shape and is provided with a lower frame 11 set in the lower portion of the interior of the case body 2, and an upper frame 12 set above the lower frame 11 and in the upper portion of the interior of the case body 2.

First, the lower frame 11 will be described.

The lower frame 11 has a back surface plate 111, a bottom plate 112, a pair of left and right side plates 113*a* and 113*b*, an X-direction movement stage housing 114, a Y-direction movement stage housing 115, and a dividing wall 116.

Bottom edges of the side plates 113*a* and 113*b* are joined respectively to left and right edges of the bottom plate 112. The side plates 113*a* and 113*b* are provided in an upright state on the bottom plate 112.

A lower portion of the back surface plate 111 is formed so as to sink forward (toward the finger insertion direction proximal side) in two stages. The bottom edge of the back surface plate 111 is joined to a front edge of the bottom plate 112, and the back surface plate 111 divides the area surrounded by the bottom plate 112 and the side plates 113*a* and 113*b* into front and back.

The space formed on the back side of the sunken back surface plate 111 becomes the X-direction movement stage housing 114 and the Y-direction movement stage housing 115 (see FIG. 1B). An X-direction movement stage 45 of the drawing unit 40 is housed in the X-direction movement stage housing 114 when the drawing unit 40 is moved forward (toward the finger insertion direction proximal side).

A Y-direction movement stage 47 of the drawing unit 40 is disposed in the Y-direction movement stage housing 115.

The dividing wall 116 is provided inside the lower frame 11 so as to vertically divide the space on the front side inside the lower frame 11 (the space on the finger insertion direction proximal side surrounded by the back surface plate 111, the bottom plate 112, and the side plates 113*a* and 113*b*).

The dividing wall 116 is provided roughly horizontally, left and right edges of the dividing wall 116 are joined respectively to the side plates 113*a* and 113*b*, and a back edge of the dividing wall 116 is joined to the back surface plate 111.

A finger securing portion 30 (see FIG. 1B) is provided integrally in the lower frame 11.

The finger securing portion 30 is configured from a finger receiving portion 31 for receiving the finger corresponding to the nail T on which drawing will be applied (hereinafter referred to as "print finger U1"), and a finger clearing portion 32 for clearing fingers other than the print finger U1 (hereinafter referred to as "non-print fingers U2").

The finger receiving portion 31 is disposed on an upper side of the dividing wall 116 and roughly in a center portion in a width direction of the lower frame 11.

The space on the lower side of the lower frame 11, partitioned by the dividing wall 116, forms the finger clearing portion 32.

For example, in cases where applying a drawing on the nail T of a ring finger, the ring finger is inserted into the finger receiving portion 31 as the print finger U1, and the non-print fingers U2, namely the other four fingers (thumb, index finger, middle finger, and little finger) are inserted into the finger clearing portion 32.

As illustrated in FIGS. 1B and 2, the finger receiving portion 31 is open to a front surface side of the lower frame 11 (print finger insertion direction proximal side); and a bottom side is defined by a finger mount portion 116*a* that constitutes a portion of the dividing wall 116, sides are defined by partitions 31*a* and 31*b*, and a rear side is defined by a partition 31*c*.

The finger mount portion 116*a* is a constituent where the finger (the print finger U1) of the nail T on which drawing is to be applied is mounted on the X-Y plane.

A top side of the finger receiving portion 31 is defined by a ceiling portion 31*d*. A window 31*e* is formed in the ceiling portion 31*d* for exposing the nail T of the print finger U1 inserted into the finger receiving portion 31.

A front wall 31*f* (see FIG. 1A) that closes the front surface side of the lower frame 11 is provided on the top surface of the dividing wall 116, at both end portions on the front surface side of the lower frame 11.

A pair of guide walls 31*g* (see FIG. 1A) that guides the print finger U1 into the finger receiving portion 31 is provided on the top surface of the dividing wall 116, and the pair of guide walls 31*g* narrows from the end of the front wall 31*f* on the center portion side toward the finger receiving portion 31.

A user can pinch the dividing wall 116 between the print finger U1 inserted into the finger receiving portion 31 and the non-print fingers U2 inserted into the finger clearing portion 32. Thus, the print finger U1 inserted into the finger receiving portion 31 is stably secured.

A test drawing portion 61 is provided on the top surface of the lower frame 11, beside the finger receiving portion 31 (location corresponding to a media access port 24 of the case body 2, on the left side in FIGS. 1A and 2). The test drawing portion 61 (described hereinafter) is for applying test drawing by the pen 41 within a drawable area of the drawing head 43 (described hereinafter).

In the present embodiment, the test drawing portion 61 also acts as a warm-up drawing portion where warm-up drawing is applied to eliminate fading and the like at a time of drawing by a pen tip (tip portion) 413.

Note that the test drawing portion 61 is formed by sinking a portion of the top surface of the lower frame 11.

A height of the test drawing portion 61 is preferably configured so as to be roughly the same as a height of the nail T when the print finger U1 is inserted into the finger receiving portion 31.

The test drawing portion 61 is a flat portion and is configured so that drawing media 61*a* inserted through the media access port 24 of the case body 2 is mounted thereon.

The drawing media (drawing subject) 61*a* mounted on the test drawing portion 61 is not limited, provided that the pen tip (tip portion) 413 can be warmed-up and test drawing can be applied, and for example, may be a piece of paper.

Note that in the present embodiment, as described hereinafter, an inspection figure ta drawn is imaged using specular reflection light R1. As such, in order to increase the contrast of the inspection figure ta with the color of the drawing media 61*a*, paper that does not specularly reflects light form a surface thereof and that diffusely reflects light from a surface thereof such as glossy paper is preferably not used and, instead, regular paper or the like is preferably applied as the drawing media 61*a*.

In the present embodiment, the test drawing by the pen 41 is applied for the purpose of detecting the actual drawing position of the pen 41, which is the drawing tool set in a pen holder 42; determining whether or not the drawing position deviates from the intended position; and, if the drawing position does deviate, detecting an amount of deviation of the drawing position by the pen 41 from the intended position. Here, the "intended position" is the drawing position of the pen 41 in a case where the shape of the pen 41 is ideal and there has been no decline in the position accuracy of the pen 41 of the drawing head 43.

Note that in the present embodiment, as described hereinafter, a pen 41 (first drawing tool) for drawing using a colorless ink which is transparent ink or a specific color ink which has substantially the same color as the drawing media 61*a* (hereinafter referred to as "first type ink") and a pen 41 (second drawing tool) for drawing using an ink that is different from the first type ink (hereinafter referred to as "second type ink") are provided as the pens 41 to be set in the pen holder 42.

In the case where the color of the drawing media 61*a* is white, the first type ink is the colorless ink or the white ink.

The color of the first type ink is not limited to the same color as the drawing media 61*a* and the color of the first type ink includes a color as the specific color where the imaging device 51 is not possible or is difficult to differentiate between areas where the first type ink has been applied and areas where the ink has not been applied in the drawing media 61*a* after the first type ink has dried.

In cases where the pen 41 uses the second type ink, by applying the test drawing by the pen 41, in addition to detecting the drawing position by the pen 41, determining whether or not the drawing position deviates from the intended position, and if the drawing position does deviate, detecting the amount of deviation of the drawing position by the pen 41 from the intended position; the type of drawing tool, namely the pen 41, set in the pen holder 42 is identified, and whether or not the pen 41 is of a type that is suitable for drawing the selected nail design (specific design image) on the drawing subject, namely the surface of the nail T (drawing subject surface) is determined.

Here, the "type" of the pen 41 is the type of ink held in the pen 41 and specifically is the color of the ink, whether the ink has glitter, and the like.

Note that the type of the pen 41 determined on the basis of the inspection figure drawn in the test drawing portion 61 is not limited to the type of ink. The type of the pen 41 may include, for example, a thickness or the like of the pen tip 413 of the pen 41 (see FIGS. 4B, 4C, and the like).

Figure 3A:
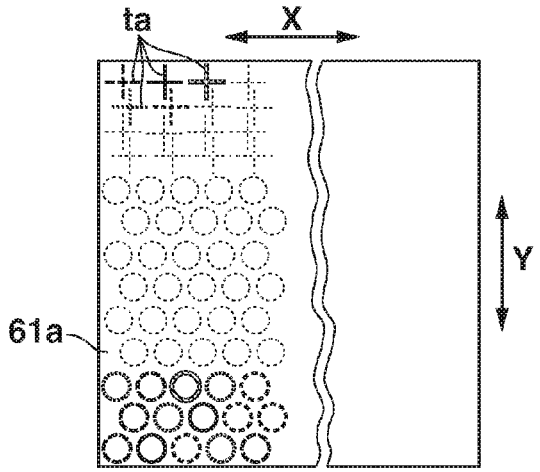
FIGS. 3A and 3B are plan views illustrating drawing examples in a case where warm-up drawing and test drawing were applied on drawing media of a test drawing portion.
Figure 3B:
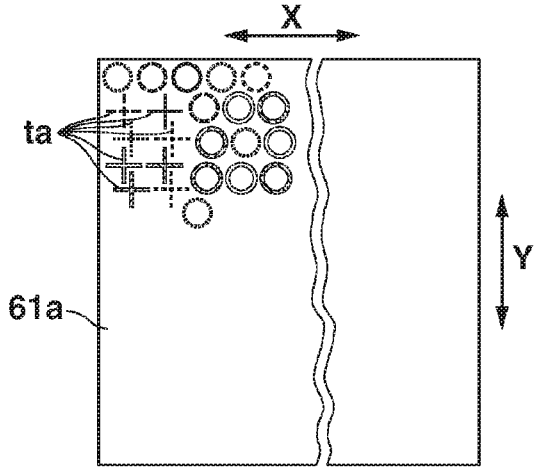

FIGS. 3A and 3B illustrate examples of inspection figures drawn on the drawing media 61*a* in cases where warm-up drawing and test drawing were applied on the drawing media 61*a* mounted on the test drawing portion 61.

Figure 3C:
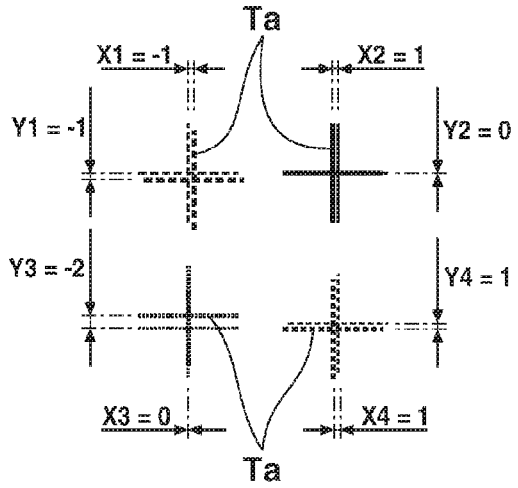
FIG. 3C is an explanatory drawing depicting positional deviations of drawing positions of an inspection figure from intended drawing positions.

FIG. 3C is an explanatory drawing depicting positional deviations from the intended drawing positions of the inspection figure.

The inspection figures drawn as the test drawing are preferably figures for which the drawing position of the pen 41 is easily detectable. Examples thereof include + symbols as illustrated in FIGS. 3A to 3C.

In this case, + symbols are drawn by the pen 41 such that, for example, a straight line along an X direction (the X direction in FIG. 1A, or the width direction of the apparatus) and a straight line along a Y direction (the Y direction in FIG. 1B, or the depth direction of the apparatus) cross orthogonally.

Note that the inspection figures drawn in the test drawing are not limited to + symbols. Other examples of the inspection figures include ○ symbols, • symbols, and the like. That is, provided that at least one point is drawn by the pen 41, it is possible to determine the drawing position and type of the pen 41. However, depending on the pen 41, fading may occur at the beginning of drawing. In cases where the inspection figure is a •symbol and fading occurs at the time of drawing, it may be difficult or impossible to detect the drawing position and determine the type of the pen 41. As such, in order to enable the reliable performance of the detection of the drawing position and the determination of the type of the pen 41, the inspection figure is preferably a figure such as a + symbol for which lines of some length and a point of intersection are drawn.

The inspection figure that was test drawn is imaged as the inspection figure to by an imaging device 51 of an imaging unit 50, and a subject image Ta is acquired for detecting the drawing position and the like. As such, all of the inspection figures (e.g. the + symbols) of the test drawing are preferably drawn within an imaging range that the imaging device 51 can image in a single instance.

Note that as described hereinafter, in cases where the test drawing is applied by the pen 41 that draws using the first type ink, the imaging is applied while the ink is wet (i.e. the period immediately after the drawing of the inspection figure until the ink is completely dry), utilizing the mirror reflection of the interface of the ink.

Here, even if imaged using the imaging device 51 after the ink has dried, it is not possible to differentiate between areas where the ink has been applied and areas where the ink has not been applied. Consequently, drawing may be repeatedly applied at positions where the pen 41 that draws using the first type ink has drawn in the past.

In contrast, in cases where the test drawing is applied by the pen 41 that draws using the second type ink, the color of the ink remains on the drawn portion even after the ink has dried. As such, with regards to the test drawing of the + symbols or similar inspection figures, the drawing position within the area of the test drawing portion 61 is preferably slightly shifted each time the test drawing is applied so that there is no overlap with previously drawn inspection figures.

As previously described, the test drawing portion 61 of the present embodiment also acts as the warm-up drawing portion where warm-up drawing of the pen tip (tip portion) 413 is applied. That is, prior to starting the drawing of the image data on the nail T, warm-up drawing is applied by lowering the pen 41 onto the drawing media 61*a* and drawing a ○ symbol, ∞ symbol, or the like, thereby bettering the condition of the pen tip 413. As a result, fading and the like at the start of the drawing due to the pen tip 413 being dried out or ink not adhering correctly can be prevented or suppressed. Therefore, the test drawing described previously is preferably applied after the warm-up drawing.

The form of the figures drawn when applying the warm-up drawing is not particularly limited. However, preferably the figure is simple, such as a ○ figure or a ∞ figure, so that the entire circumference of the pen tip is used and ink is not wasted. With regards to the warm-up drawing of the ○ figure, the ∞ figure or similar figures, the drawing position within the area of the test drawing portion 61 is preferably slightly shifted each time the warm-up drawing is applied so that there is no overlap with figures previously drawn in the warm-up drawing or the test drawing.

In the present embodiment, as illustrated in FIG. 3A, prior to beginning the drawing, the ○ or similar figure is first drawn as the warm-up drawing in blank space at a first edge side of the drawing media 61*a* (e.g. the left side in the X direction and proximal side in the Y direction of the drawing media 61*a*). Then, after warming-up the pen tip 413, a + or similar inspection figure is drawn as the test drawing in blank space on a second edge side of the drawing media 61*a* (e.g. the left side in the X direction and the distal side in the Y direction of the drawing media 61*a*).

Note that as illustrated by the broken lines in FIG. 3A, the ○ figure as the warm-up drawing is drawn while shifting the drawing position from the first edge side to the second edge side of the drawing media 61*a*.

Additionally, the + inspection figure as the test drawing is drawn while shifting the drawing position from the second edge side to the first edge side of the drawing media 61*a*.

Moreover, when there is no more blank space in a given row, the position of pen tip 413 is, for example, shifted in the X direction (e.g. the right side in the X direction in FIG. 3A), and, likewise, the ○ figure as the warm-up drawing and the + inspection figure as the test drawing are drawn while shifting the positions of each from the first edge side and from the second edge side of the drawing media 61*a*.

Note that the positions where the ○ or similar figure as the warm-up drawing and the + or similar inspection figure as the test drawing are drawn is not limited thereto.

For example, as illustrated in FIG. 3B, the ○ or similar figure as the warm-up drawing and the + or similar inspection figure as the test drawing may be drawn until there is no more blank space, without separating them into particular regions.

Moreover, when the ○ and + figures have been drawn on roughly all of the drawing media 61*a* and there is no more blank space, a display screen prompting for replacement of the drawing media 61*a* as in, for example, "Replace paper" is displayed in the display unit 26.

In this case the test drawing and the warm-up drawing on a new drawing media 61*a* can be enabled by a user removing the used drawing media 61*a* and installing the new drawing media 61*a* via the media access port 24.

For example, in cases where the drawing media 61*a* is a paper roll, when there is no more drawing space, the drawing media 61*a* is fed out from the paper roll so that the test drawing and the warm-up drawing can be applied on a new drawing surface.

Note that, as described previously, in cases where applying the warm-up drawing or the test drawing using the first type ink, provided that the ink has dried, the warm-up drawing or the test drawing can be repeatedly applied at places where drawing has been applied in the past. As such, in cases where only the pen 41 that draws using the first type ink is used, the same drawing media 61*a* can be used for a long period of time.

A home area 60 where the drawing head 43 stands by at times when the drawing head 43 is not drawing is provided on the top surface of the lower frame 11, beside the finger receiving portion 31 (in the present embodiment, the right side in FIGS. 1A and 2), within a movable range of the drawing head 43 described hereinafter.

A number of pen caps 62 (in the present embodiment, one) exactly corresponding to the pen holder 42 described hereinafter are set in the home area 60.

An ink jet maintenance portion 63 is provided within the home area 60, at a position corresponding to a position where the ink jet drawing portion 71 is disposed when the pen tip 413 is stored in the pen cap 62. The ink jet maintenance portion 63 is configured from, for example, a cleaning mechanism for cleaning an ink discharging portion (nozzle surface) of the ink jet drawing portion 71 described hereinafter, a cap mechanism for maintaining moist conditions of the ink discharging portion (nozzle surface), and the like (all not illustrated in the drawings).

Note that the disposal of the pen cap 62, the ink jet maintenance portion 63, and the like in the home area is not limited to the examples described herein.

The drawing unit 40 is configured from and provided with the drawing head 43, a unit supporting member 44 that supports the drawing head 43, the X-direction movement stage 45 for moving the drawing head 43 in the X direction (the X direction in FIGS. 1A and 2; the left-right direction of the drawing apparatus 1), an X-direction movement motor 46, the Y-direction movement stage 47 for moving the drawing head 43 in the Y direction (the Y direction in FIGS. 1B and 2; the front-back direction of the drawing apparatus 1), a Y-direction movement motor 48, and the like.

Figure 4A:
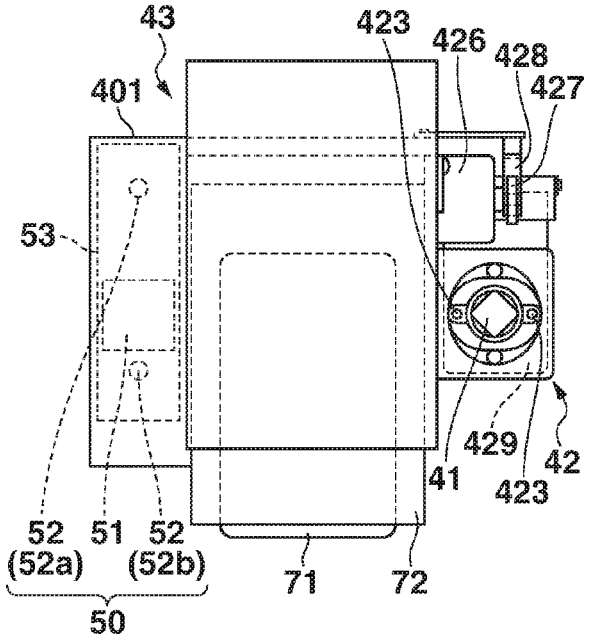
FIG. 4A is a top view of a drawing head according to the embodiment of the present invention.
Figure 4B:
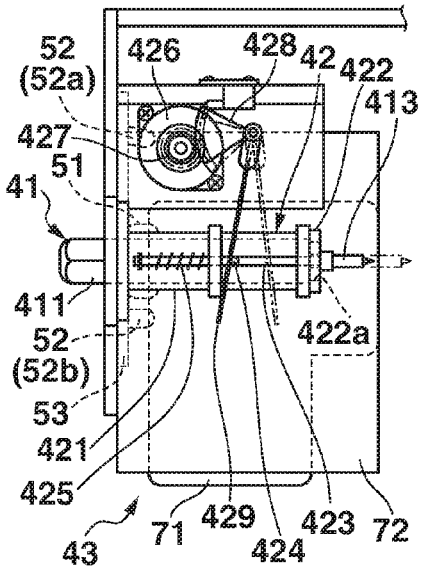
FIG. 4B is a side view of the drawing head according to the embodiment of the present invention.

FIG. 4A is a top view of the drawing head and FIG. 4B is a side view of the drawing head according to the present embodiment.

As illustrated in FIGS. 4A and 4B, the pen 41 is set in the drawing head 43 of the present embodiment; and the pen holder 42 holding the pen and an ink jet holder 72 holding the ink jet drawing portion 71 are disposed adjacently to each other.

The ink jet drawing portion 71 is, for example, an ink cartridge-integrated head in which ink cartridges (not illustrated in the drawings) corresponding to yellow (Y), magenta (M), and cyan (C) ink are formed integrally with an ink discharging portion (not illustrated in the drawings) provided on a surface (in the present embodiment, the bottom surface in FIG. 1A and the like) facing the drawing subject (the nail T) in each of the ink cartridges.

The ink discharging portion is provided with a nozzle array consisting of a plurality of nozzles for spraying each color of ink. The ink jet drawing portion 71 micronizes the ink and applies the drawing by spraying the ink from the ink discharging portion directly on the target drawing surface of the drawing subject (the nail T).

Note that the ink jet drawing portion 71 is not limited to those that discharge the three colors of ink described previously. Ink cartridges holding other ink and ink discharging portions may also be provided.

One pen 41 is mountable in the pen holder 42 of the present embodiment.

The pen 41 is a writing utensil (drawing tool) that has the surface of the nail T as its drawing subject surface, and applies a drawing by the tip portion thereof being brought into contact with the drawing subject surface, namely the surface of the nail T.

As illustrated in FIG. 4B and the like, the pen 41 is provided with the pen tip 413 on a tip side of a rod-like pen shaft portion 411 (lower side in FIG. 4B).

An interior of the pen shaft portion 411 is an ink storing portion for storing various types of ink.

Any type of ink can be stored in the interior of the pen shaft portion 411. Viscosity of ink, diameter of the coloring particles (particle size), and the like are not particularly limited and, for example, ink having metallic glitter, white ink, UV-curable ink, ink for gel nails, ink for under coats, ink for top coats, nail varnish, and the like can be used.

In the present embodiment, as described previously, a first drawing tool, namely the pen 41, for drawing using a colorless ink or the specific color ink, for example a white ink, i.e. the first type ink, and a second drawing tool, namely the pen 41, for drawing using an ink that is different from the first type ink, i.e. the second type ink, are provided as the pens 41 settable in the pen holder 42.

For example, white ink used for an under coat or the like or colorless ink or the like used for a top coat or the like of the nail T is stored in the pen shaft portion 411 of the pen 41 that draws using the first type ink.

In the present embodiment, the pen 41 is a ballpoint pen in which the pen tip 413 draws by the ink stored in the pen shaft portion 411 being dispensed by pressing the pen tip 413 against the surface of the nail T.

Note that the pen 41 is not limited to a ballpoint pen. For example, the pen 41 may be a felt-tip pen that draws by soaking ink into a felt-like pen tip, a brush pen that draws by soaking ink into a bundle of hairs, or the like. The pen 41 having the pen tip 413 of any desired thickness may be provided as well.

Each of a plurality of the pens 41 is replaced and set in the pen holder 42. Each of the plurality of pens 41 that are replaced and set in the pen holder 42 may be pens that all have the same type of the pen tip 413, or may be pens that have different types of the pen tip 413.

The pen 41 is held by simply inserting it in the pen holder 42 from above. As such, the pen 41 can be easily replaced by opening the cover 23 provided in the case body 2 and, for example, using hands or tweezers to grab a top end portion of the pen shaft portion 411 and lift the pen 41 out.

Thus, a user can realize a wide range of nail designs by appropriately exchanging the pen 41 set in the pen holder 42 for a pen 41 having a different color or a different pen tip 413, or using a different type of ink, depending on the nail design desired to be drawn.

The pen holder 42 is provided with a tubular member 421 that is open vertically and into which the pen 41 is inserted, a pen retaining member 422 disposed so as to block an opening on a bottom side of the tubular member 421 (the bottom side in FIG. 4B), and an auxiliary rod member 423 that moves vertically with the pen 41.

A retaining hole 422*a* that retains the tip side of the pen shaft portion 411 of the pen 41 is formed in the pen retaining member 422.

The pen 41 is retained in the pen holder 42 by the tip side of the pen shaft portion 411 being inserted in the retaining hole 422*a* of the pen retaining member 422.

Note that screw grooves (not illustrated in the drawings) may be formed in an outer circumferential surface of the tip side of the pen shaft portion 411, screw grooves (not illustrated in the drawings) capable of mating with the screw grooves of the shaft portion may be formed in an inner circumferential surface of the retaining hole 422*a*, and the pen 41 may be retained in the retaining hole 422*a* by screwing the screw grooves on the pen shaft portion 411 side into the screw grooves on the retaining hole 422*a* side.

In the present embodiment, two of the auxiliary rod members 423 are disposed so as to sandwich the pen 41. A bottom end of each of the auxiliary rod members 423 is mated with the pen retaining member 422 and, thereby, the auxiliary rod members 423 are fixed so as to be parallel with the pen shaft portion 411 of the pen 41.

A retaining protrusion 424 protruding in a direction away from the axial center of the pen 41 is provided on the auxiliary rod members 423.

A coil spring 425 is wrapped around the rod of the auxiliary rod members 423.

The coil spring 425 is configured to apply force in an upward direction to the auxiliary rod member 423 in a state free of outside forces and holds the position of the pen 41 when not drawing at a position where the pen tip 413 does not contact the nail T.

A pen vertical motor 426 constituted by a stepping motor, a gear 428 that engages with a gear 427 attached to a rotating shaft of the pen vertical motor 426, and a plate spring 429 that pivots along with the rotation of the gear 428 are provided in the vicinity of the pen holder 42.

In the present embodiment, a lifting mechanism of the pen 41 is constituted by the pen vertical motor 426, the gear 427, the gear 428, the plate spring 429, and the like.

Here, the plate spring 429 engages with the retaining protrusion 424 provided on the auxiliary rod member 423 and presses the retaining protrusion 424 down, thereby pressing the pen 41 downward.

That is, when the plate spring 429 pivots along with the rotation of the pen vertical motor 426 and the plate spring 429 engages with the retaining protrusion 424 and presses the retaining protrusion 424 downward, the pen 41 is pressed downward against the biasing force of the coil spring 425.

The present embodiment has a configuration in which the pen 41 is not pressed down directly by the plate spring 429; instead, the plate spring 429 presses down on the retaining protrusion 424. Thus, a structure is realized in which the plate spring 429 is not disposed over the pen 41. As a result, the pen 41 can be easily replaced, a height of the lifting mechanism of the pen 41 can be kept comparatively small, and space can be conserved.

Next, a detailed description of the lifting mechanism of the pen 41 is given.

First, when not drawing, the plate spring 429 is in a state where not applying outside pressure to the retaining protrusion 424. In the state where outside pressure (pressing force by the plate spring 429) is not applied, the pen 41 is pressed up to a position in an upward direction (the upward direction in FIGS. 1A and 4B) by the biasing force of the coil spring 425, and the tip side of the pen 41, that is, the pen tip 413, is separated from the drawing subject surface, namely the surface of the nail T, and held at a height where not contacting the surface.

On the other hand, when drawing, the pen vertical motor 426 rotates a prescribed number of steps and the plate spring 429 presses the retaining protrusion 424 down. Thereby, the pen 41 is pressed down.

The prescribed number of steps when driving the pen vertical motor 426 is appropriately set depending on a height and the like of the nail T of the print finger U1 inserted into the finger receiving portion 31.

That is, in the nail printing apparatus 1 of the present embodiment, nail information (described hereinafter) is acquired in advance.

Moreover, the height of the nail T at a contact position where the tip side of the pen 41, namely the pen tip 413, contacts the nail T is confirmed on the basis of the nail information, and the number of steps of the pen vertical motor 426 is determined on the basis of the height of the nail T.

The pen vertical motor 426 is driven the determined number of steps and the plate spring 429 presses the pen 41 down. Thus, the tip side of the pen 41, namely the pen tip 413 is moved toward to contact the surface of the nail T and an appropriate amount of pen pressure is applied.

Note that when drawing, the height of the nail T changes throughout the drawing. Each time a change occurs, the number of steps of the pen vertical motor 426 is increased or decreased, so that the pen pressure of the pen 41 is adjusted. Thus, drawing is applied while making adjustments to ensure that the pen pressure is roughly constant.

Here, the adjustment to the pen pressure by increasing or decreasing the number of steps of the pen vertical motor 426 is performed each time a change occurs, when the height of the nail T changes by a predetermined amount (e.g. 0.5 mm) When the change in the height of the nail T is less than the predetermined amount, no adjustment is made to the pen pressure. However, in these cases, the pen 41 will automatically move vertically due to the plate spring 429 flexibly deforming (elastically deforming) along with the shape of the nail T and, thus, the pen 41 can be made to reliably contact the nail T and, simultaneously, the pen pressure can be maintained at a suitable value.

Note that a spring constant of the plate spring 429 is not that great and is set to a value of a magnitude where pain is not felt by the nail T when the pressing force (outside force) of the plate spring 429 is applied to the nail T.

When drawing, impact due to the vertical movement of the pen 41 is absorbed by the plate spring 429 flexing a suitable degree and the pen 41 moves vertically along with the height of the nail T while maintaining a suitable degree of pen pressure of the pen tip 413 in a roughly constant manner. Thus, the desired nail design can be drawn neatly on the surface of the drawing subject, namely the nail T.

The unit supporting member 44 is fixed to the X-direction movement portion 451 that is attached to the X-direction movement stage 45. The X-direction movement portion 451 is configured to move in the X direction along guides (not illustrated in the drawings) on the X-direction movement stage 45 via the driving of the X-direction movement motor 46. Thus, the drawing head 43 that is attached to the unit supporting member 44 is configured to move in the X direction (the X direction in FIG. 1A and the left-right direction of the nail printing apparatus 1).

The X-direction movement stage 45 is fixed to a Y-direction movement portion 471 of the Y-direction movement stage 47.

The Y-direction movement portion 471 is configured to move in the Y direction along guides (not illustrated in the drawings) on the Y-direction movement stage 47 via the driving of the Y-direction movement motor 48. Thus, the drawing head 43 that is attached to the unit supporting member 44 is configured to move in the Y direction (the Y direction in FIG. 1B and the front-back direction of the nail printing apparatus 1).

Note that in the present embodiment, the X-direction movement stage 45 and the Y-direction movement stage 47 are configured from combinations of the X-direction movement motor 46, the Y-direction movement motor 48, and ball screws and guides (not illustrated in the drawings).

In the present embodiment, a head movement portion 49 is configured as an XY drive unit that drives the drawing head 43 provided with the pen 41 in the X direction and the Y direction via the X-direction movement motor 46, the Y-direction movement motor 48, and the like.

The pen vertical motor 426, the ink jet drawing portion 71, the X-direction movement motor 46, and the Y-direction movement motor 48 of the drawing unit 40 are connected to a drawing control portion 817 of a control device 80 (see FIG. 6; described hereinafter), and are configured to be controlled by the drawing control portion 817.

The imaging unit 50 is provided with the imaging device 51 and an illumination device 52.

The imaging unit 50 illuminates the nail T of the print finger U1, which is inserted into the finger receiving portion 31 and is visible through the window 31*e*, using the illumination device 52.

Moreover, the print finger U1 is imaged using the imaging device 51 and a nail image, namely an image of the nail T of the print finger U1 (image of finger including nail image) is obtained.

In the present embodiment, the imaging device 51 and the illumination device 52 are fixed on a side (the left side of the drawing head 43 in FIG. 1A) of the drawing head 43 of the drawing unit 40.

Specifically, as illustrated in FIG. 4A, the drawing head 43 of the drawing unit 40 has an overhanging portion 401 overhanging in a lateral direction from a first edge (the left side in FIG. 4A) of the top surface of the drawing head 43, and a substrate 53 is attached to the overhanging portion 401.

The imaging device 51 and the illumination device 52 constituting the imaging unit 50 are provided on a lower surface of the substrate 53 at orientations facing the dividing wall 116.

Note that a size of the substrate 53 and positions where the imaging device 51 and the illumination device 52 are attached to the substrate 53 are not particularly limited.

The imaging device 51 is, for example, a small camera having a solid state image sensor with a pixel count of about 2 million pixels or greater, a lens, and the like.

The imaging device 51 is configured to detect curvature and the like of the nail T of the print finger U1 by movement of the head movement portion 49 so as to image the nail T from, for example, two mutually different positions or angles.

As a result, for example, two of the nail images are acquired and a nail information detection portion 812 (described hereinafter) detects the nail information such as an outline of the nail T (shape of the nail T), curved shape of the nail T (curvature of the nail T), vertical position of the nail T, and the like on the basis of the nail images.

Figure 5A:
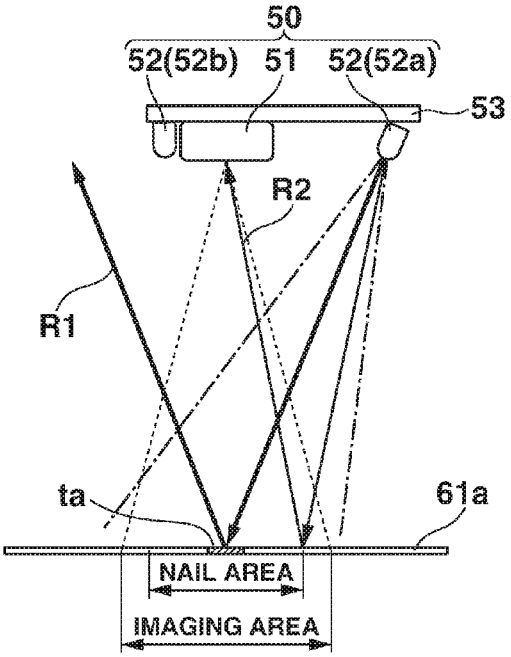
FIGS. 5A to 5C are explanatory drawings illustrating positional relationships between an imaging device and an illumination device as well as light from the illumination device and reflected light thereof.

Note that in the present embodiment, due to the fact that the imaging device 51 can be moved to above the nail T of the print finger U1, which is inserted in the finger receiving portion 31, by the head movement portion 49 and imaging can be performed, it is sufficient that an imaging area of the imaging device 51 covers the area of one nail T (e.g. the nail area in FIG. 5A).

The illumination device 52 has at least one light source for radiating light. The light source is, for example, a white LED or similar illuminating lamp.

For example, two of the light sources of the illumination device 52 are disposed on a front side and a back side of the imaging device 51 so as to sandwich the imaging device 51.

The illumination device 52 radiates light toward the dividing wall 116 side below, and illuminates at least a portion of the imaging area of the imaging device 51, which is below the imaging device 51.

In the present embodiment, the illumination device 52 includes a first light source 52*a* for producing diffused reflection at the surface of the imaging subject (that is, the nail T or the drawing media 61*a*), and a second light source 52*b* for producing specular reflection (mirror reflection) at the surface of the imaging subject (that is, the drawing media 61*a*).

Figure 5B:
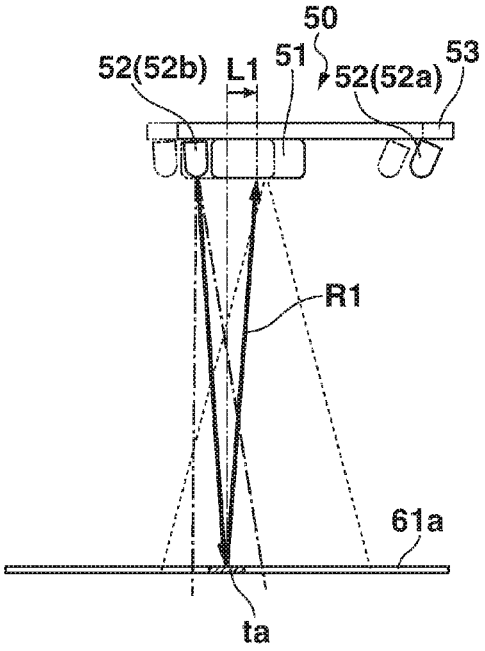
Figure 5C:
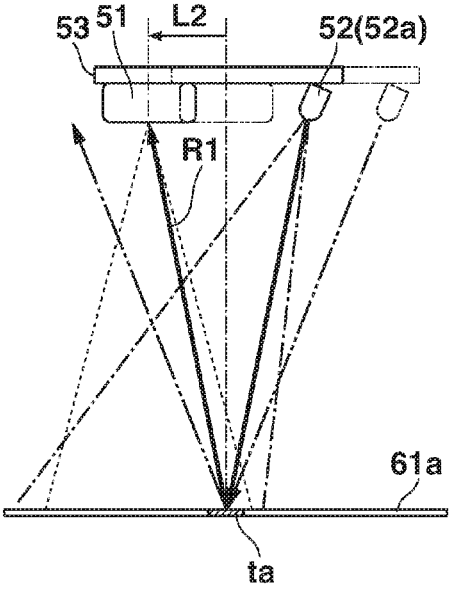

FIGS. 5A to 5C are schematic explanatory drawings illustrating the positional relationships between the imaging device 51 and the first and second light sources 52*a* and 52*b*, and light radiated from the first and second light sources 52*a* and 52*b* and reflected light thereof.

Note that in FIGS. 5A to 5C, solid lines represent the light radiated from the illumination device 52 and reflected light thereof, dot-dash lines represent the illumination area of the illumination device 52, and dashed lines represent the imaging area of the imaging device 51.

The first light source 52*a* is the light source used when imaging the nail T or imaging the inspection figure ta drawn by the pen 41 for color drawing using the second type ink.

As illustrated in FIG. 5A, the first light source 52*a* of the illumination device 52 is disposed a desired distance away from the imaging device 51 and, in cases where, for example, the imaging device 51 is disposed roughly directly above the nail T and imaging is performed, the first light source 52*a* is capable of radiating light on the area, represented by the dot-dash lines, wider than the imaging area of the imaging device 51.

In cases where imaging the nail T, the light radiated from the first light source 52*a* enters the plane occupied by the end of the nail T and diffusely reflects at the surface or the like of the nail T. A portion of the reflected light (that is, light entering the light receiving area of the lens (not illustrated in the drawings) of the imaging device 51 among the diffused reflection light R2) enters the imaging device 51 (the lens of the imaging device 51).

For example, in cases where the imaging device 51 is disposed roughly directly above the inspection figure ta and the inspection figure ta drawn on the drawing media 61*a* is imaged, the light radiated from the first light source 52*a* enters the area (drawn area) where the inspection figure ta is drawn.

Moreover, a portion of the diffused reflection light R2 diffusely reflected at the surface or the like of the inspection figure ta (that is, light entering the light receiving area of the lens of the imaging device 51 among the diffused reflection light R2) enters the imaging device 51 (the lens (not illustrated in the drawings) of the imaging device 51).

Therefore, an image of the inspection figure ta (hereinafter referred to as the "subject image Ta") can be acquired as a result of the diffused reflection light R2 from the area where the drawing was applied being captured in the imaging unit 50 (the imaging device 51).

Here, because the first light source 52*a* is disposed at a position away from the imaging device 51, the specular reflection light R1 represented by the bold solid lines in FIG. 5A, which is specularly reflected after entering the inspection figure ta, does not enter the imaging device 51 at the arrangement illustrated in FIG. 5A.

As a result, the specular reflection light R1 radiated from the first light source 52*a*, which enters the inspection figure ta and specularly reflects at a surface thereof, does not enter the imaging device 51 and is not captured by the imaging device 51.

On the other hand, the second light source 52*b* is the light source used when imaging the inspection figure ta drawn by the first drawing tool 41, namely the pen 41 using the first type ink such as colorless ink or the specific color ink.

As illustrated in FIG. 5B, the second light source 52*b* is disposed at a position nearer to the imaging device 51 than the first light source 52*a*.

In the present embodiment, when, for example, imaging the inspection figure ta, the drawing head 43 is moved in the horizontal direction (i.e. arrow direction) of FIG. 5B, and the imaging device 51 and the second light source 52*b* are disposed at positions such that an angle of incidence of the light entering the inspection figure ta from the second light source 52*b* and an angle of reflection of the light reflecting at the surface of the inspection figure ta are identical angles with respect to the reflection surface (here, the drawing media 61*a* where the inspection figure ta is drawn).

Note that the second light source 52*b* is disposed at a position nearer to the imaging device 51 than the first light source 52*a*. As such, a movement distance L1 for moving the imaging device 51 and the second light source 52*b* to the positions illustrated in FIG. 5B from the positions where the imaging device 51 captures the diffused reflection light R2 illustrated in FIG. 5A is just barely sufficient as illustrated in FIG. 5B.

As a result of disposing the imaging device 51 and the second light source 52*b* at these positions, the light radiated from the second light source 52*b* enters the inspection figure ta and specularly reflects at the surface thereof as the specular reflection light R1, which enters the imaging device 51 (the lens of the imaging device 51). Thus, the specular reflection light R1 can be captured by the imaging device 51.

In cases where drawing is applied on white paper or the like as the drawing media 61*a* using the second type ink such as the colorless ink or the specific color ink, there is hardly no difference in color between the portion drawn using the second type ink and the background, namely the drawing media 61*a*. Consequently, it is difficult or impossible to acquire the subject image Ta of the inspection figure ta in the mode where the diffused reflection light R2 from the area where the drawing was applied is captured in the imaging unit 50.

Here, the surface of the ink used in the drawing by the pen 41 is in a wet state due to remaining moisture or solvent for the period immediately after the drawing until the ink has completely dried or, in other words, while the applied ink is not dry (e.g. a period approximately from 20 to 30 seconds after application).

Therefore, prior to the ink completely drying, if, as illustrated in FIG. 5B, the imaging device 51 and the illumination device 42 are disposed above the inspection figure ta where the ink is wet at a positional relationship where imaging of the specular reflection light R1 is possible, and light is radiated from the second light source 52*b* toward the inspection figure ta, the light that enters the surface of the inspection figure ta will specularly reflects (mirror reflect) at the surface thereof and the specular reflection light R1 will enter the imaging device 51 (the lens of the imaging device 51).

Here, while a difference of about 10-times in the amount of light is sufficient to view contrast in the imaging device 51, the difference in the amount of light of the specular reflection light R1 compared to the diffused reflection light R2 is about 100-times.

As such, in cases where the inspection figure ta, where light specularly reflects, is drawn on the drawing media 61*a*, where light diffusely reflects (that is, the inspection figure ta in a state prior to the ink completely drying, where the ink is wet), sufficient contrast between the portions where the inspection figure ta is drawn and portions where not drawn can be obtained.

Additionally, after imaging, by setting the brightness or the like of the image to a mid-range on the imaging device 51 side, an image can be acquired in which the portions of the drawing media 61*a* where ink was not applied appear black, and only the portions where the ink was applied appear white. The image acquired in this manner can be used as the subject image Ta obtained by imaging the inspection figure ta drawn using the first type ink.

Note that as illustrated in FIG. 5C, in cases where the drawing head 43 is moved in the horizontal direction (i.e. arrow direction) of FIG. 5C, and the imaging device 51 and the first light source 52*a* are disposed at positions such that an angle of incidence of the light entering the inspection figure ta from the first light source 52*a* and an angle of reflection of the light reflecting at the surface of the inspection figure ta are identical angles with respect to the reflection surface (here, the drawing media 61*a* where the inspection figure ta is drawn), the light radiated from the first light source 52*a* enters the inspection figure ta and specularly reflects at the surface thereof as the specular reflection light R1, which can be captured by the imaging device 51.

In this case, the second light source 52*b* for separately producing specular reflection is not required.

However, in this case, when imaging the inspection figure ta, an amount of movement L2 of the drawing head 43 from the position where the imaging device 51, illustrated in FIG. 5A, captures the diffused reflection light R2, is greater than the movement distance L1 in the case illustrated in FIG. 5B where the second light source 52*b* produces the specular reflection. Consequently, there is a possibility that the size of the device will increase.

Therefore, the second light source 52*b* for producing specular reflection is preferably provided separately from the first light source 52*a* for producing diffused reflection.

Note that the disposal and number of the illumination devices 52 provided is not limited to the illustrated examples.

The imaging unit 50 is connected to an imaging control portion 811 of the control device 80 (described hereinafter, see FIG. 6), and is configured to be controlled by the imaging control portion 811.

Image data of the nail image imaged by the imaging unit 50 are stored in a nail image memory region 821 of a memory unit 82 (described hereinafter).

The image data of the subject image Ta imaged by the imaging unit 50 is sent to a drawing tool determination portion 813 and a drawing position correction portion 814 (described hereinafter, see FIG. 6).

The control device 80 is, for example, arranged on a substrate 13 or the like disposed in the upper frame 12.

Figure 6:
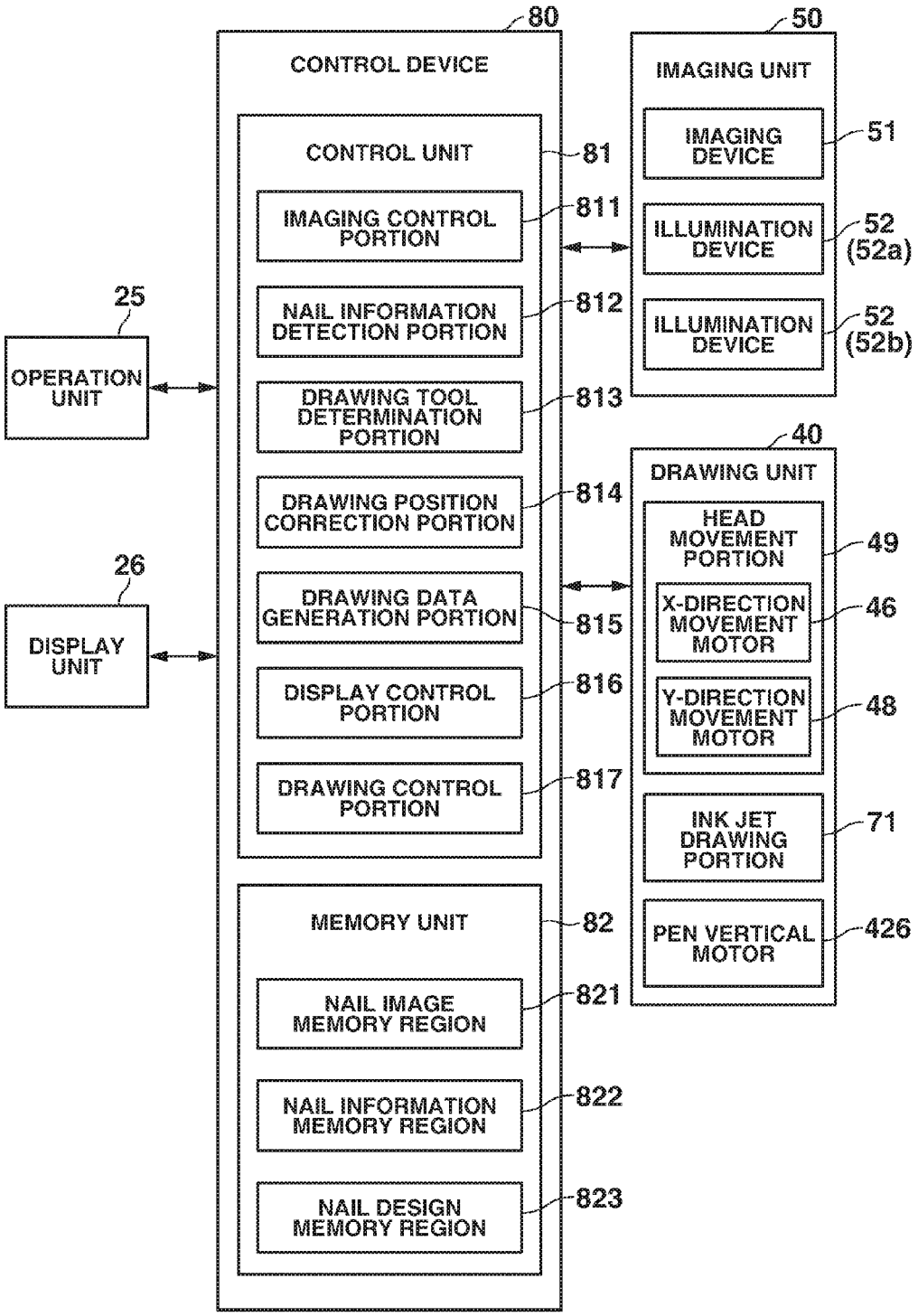
FIG. 6 is a main constituent block diagram showing a control configuration of the drawing apparatus according to the embodiment of the present invention.
Figure 7:
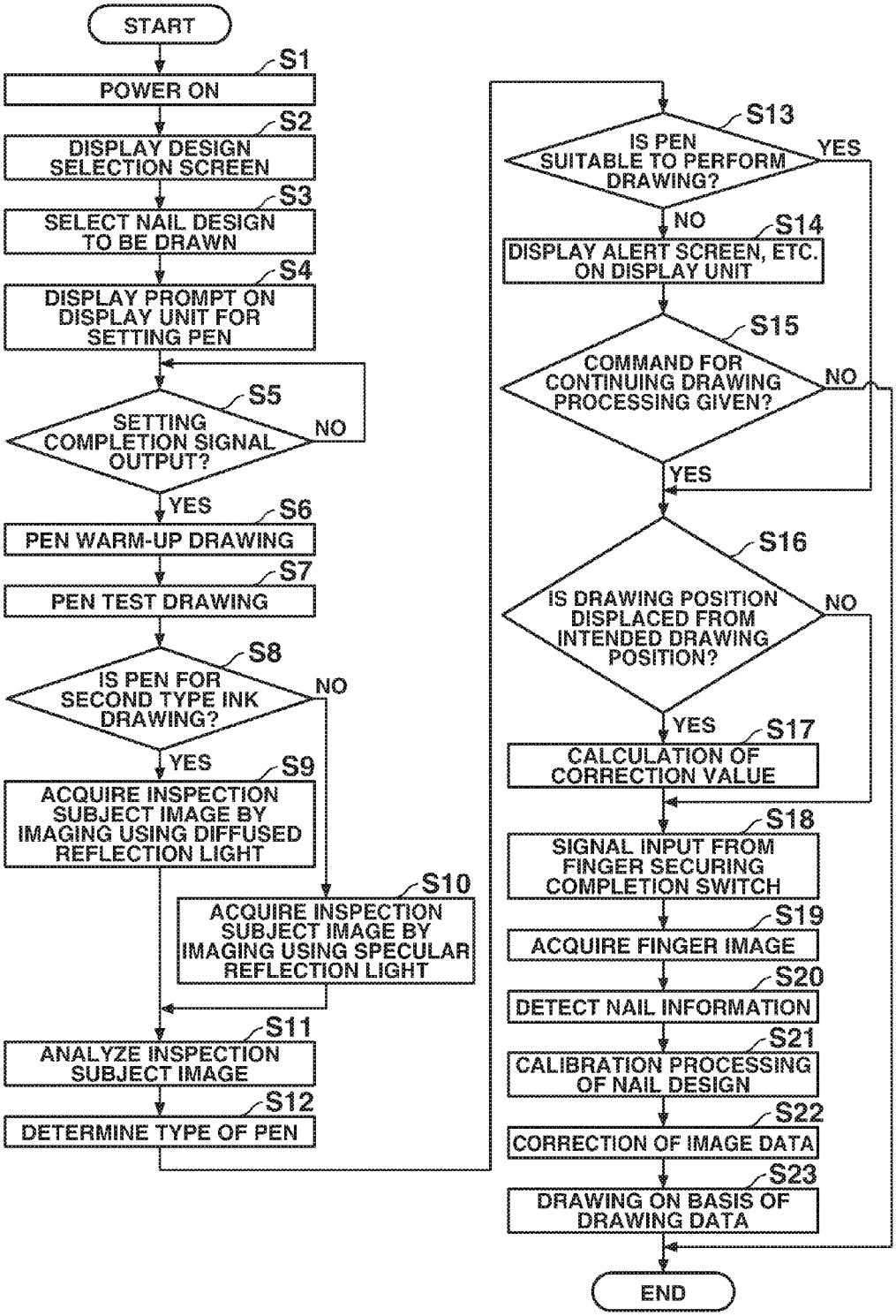
FIG. 7 is a flowchart showing drawing processing according to the embodiment of the present invention.

FIG. 6 is a main constituent block diagram showing a control configuration according to the present embodiment.

As illustrated in FIG. 6, the control device 80 is a computer provided with a control unit 81 constituted by a central processing unit (CPU) (not illustrated in the drawings), and a memory unit 82 constituted by a read only memory (ROM), a random access memory (RAM), or the like (neither illustrated in the drawings).

Various programs to operate the nail printing apparatus 1, various data, and the like are stored in the memory unit 82.

Specifically, various programs are stored in the ROM of the memory unit 82 such as, for example, a nail information detection program for detecting the nail information such as the shape of the nail T and the outline of the nail T from the finger image, a drawing tool determination program for determining the type of the pen 41, a drawing position correction program for correcting drawing positions, a drawing data generation program for generating drawing data, a drawing program for drawing processing, and the like.

These programs are executed by the control device 80 and, thus, the components of the nail printing apparatus 1 are controlled in an integrated manner.

In the present embodiment, the memory unit 82 is provided with the nail image memory region 821 where the finger image of the nail T of the print finger U1 of a user acquired by the imaging unit 50 is stored, a nail information memory region 822 where the nail information detected by the nail information detection portion 812 (the outline of the nail T, inclination angle of the nail T, and the like) is stored, and a nail design memory region 823 where image data of a nail design to be drawn on the nail T is stored.

When viewed from a function perspective, the control unit 81 is provided with the imaging control portion 811, the nail information detection portion 812, the drawing tool determination portion 813, the drawing position correction portion 814, a drawing data generation portion 815, a display control portion 816, a drawing control portion 817, and the like.

Functions of the imaging control portion 811, the nail information detection portion 812, the drawing tool determination portion 813, the drawing position correction portion 814, the drawing data generation portion 815, the display control portion 816, the drawing control portion 817, and the like are realized by cooperation of the CPU of the control unit 81 and the programs stored in the ROM of the memory unit 82.

The imaging control portion 811 is configured to cause the imaging device 51 to image finger images, including images of the nail T of the print finger U1 inserted into the finger receiving portion 31, by controlling the imaging device 51 and the illumination device 52 of the imaging unit 50.

In the present embodiment, the imaging device 51 is moved by the drawing control portion 817 that controls the head movement portion 49, and the imaging control portion 811 causes two of the nail images from, for example, two different positions or angles (e.g. directly above the nail T and diagonally above the nail T, or the like), to be acquired.

The image data of the nail image acquired by the imaging unit 50 are stored in the nail image memory region 821 of the memory unit 82.

In the present embodiment, in cases where the + or similar inspection figure, namely the inspection figure ta, is drawn in the test drawing portion 61, the imaging control portion 811 causes the imaging device 51 to image the inspection figure ta and acquire the subject image Ta.

As described previously, in the present embodiment, the illumination device 52 used in the imaging of the inspection figure ta is configured to be switched depending on whether the pen 41 that draws using the first type ink or the pen 41 that draws using the second type ink is used.

Specifically, when the pen 41 that draws using the second type ink is mounted in the pen holder 42, after the inspection figure ta is drawn on the drawing media 61*a* by the pen 41 that uses the second type ink, the imaging control portion 811 causes the first light source 52*a* disposed at the position away from the imaging device 51 to light and causes the imaging device 51 to image the surface of the drawing media 61*a* including the area where the inspection figure ta is drawn.

The light radiated from the first light source 52*a* diffusely reflects at the surface of the inspection figure ta and the drawing media 61*a* including the inspection figure ta, and the diffused reflection light R2 is captured by the imaging device 51.

As a result, the subject image Ta of the inspection figure ta drawn by the pen 41 that uses the second type ink is acquired.

When the pen 41 that draws using the first type ink is mounted in the pen holder 42, after the inspection figure ta is drawn on the drawing media 61*a* by the pen 41 that uses the first type ink and prior to the ink completely drying, the imaging control portion 811 causes the second light source 52*b* disposed at the position in the vicinity of the imaging device 51 to light and causes the imaging device 51 to image the surface of the drawing media 61*a* including the area where the inspection figure ta is drawn.

The light radiated from the second light source 52*b* diffusely reflects at the surface of the drawing media 61*a* and specularly reflects (mirror reflects) at the surface of the inspection figure ta drawn with wet ink.

The diffused reflection light R2 from the surface of the drawing media 61*a* and the specular reflection light R1 from the surface of the inspection figure ta are captured by the imaging device 51.

Moreover, the brightness settings and the like on the imaging device 51 side are adjusted so that the portion of the diffused reflection light R2 appears black and the portion of the specular reflection light R1 appears white. Thereby, the subject image Ta of the inspection figure ta is acquired in which only the portion of the inspection figure ta drawn using the first type ink appears white.

Note that as described previously, in the present embodiment, one pen holder 42 is provided in the drawing head 43 and the pen 41 mounted in the pen holder 42 is appropriately replaced so that nail designs can be drawn on the nail T using various types of ink.

The subject image Ta is preferably acquired immediately before drawing on the nail T by the pen 41. For example, the warm-up drawing and the test drawing is applied in the test drawing portion 61 and the inspection figure ta drawn on the drawing media 61*a* is imaged prior to mounting the pen 41 in the pen holder 42 and beginning the drawing on the nail T.

The nail information detection portion 812 is configured to detect the nail information of the nail T of the print finger U1 on the basis of the image of the nail T of the print finger U1 inserted into the finger receiving portion 31, the image being imaged by the imaging device 51.

Here "nail information" refers to, for example, the outline of the nail T (nail shape, XY coordinates of the horizontal position of the nail T, and the like), the height of the nail T (position in the vertical direction of the nail T, hereinafter referred to as the "vertical position of the nail T" or simply the "position of the nail T"), and the inclination angle with respect to the XY plane of the surface of the nail T (the inclination angle of the nail T or nail curvature).

The nail information detection portion 812 can accurately detect the curvature and the like of the nail T by performing the detection of the nail information using a plurality of nail images imaged from different positions or angles (e.g. directly above the nail T, diagonally above the nail T, and the like).

The drawing tool determination portion 813 identifies the type of the drawing tool, namely the pen 41, mounted in the pen holder 42 from the subject image Ta imaged by the imaging unit 50, and also determines whether the type of the pen 41 is included in the types required to draw the nail design (specific design image) selected by the user to be drawn on the drawing subject surface, namely the nail T.

Specifically, the drawing tool determination portion 813 analyzes the image of the subject image Ta and, in cases where there is no drawing at the position where the subject image Ta is expected to be, the drawing tool determination portion 813 determines that the pen 41 is not mounted in the pen holder 42 or that ink is not being dispensed and that the pen 41 cannot be used to draw.

In cases where the + or similar figure (the inspection figure ta) is drawn at the position where the subject image Ta is expected to be, the drawing tool determination portion 813 determines the type of the pen 41 from the + or similar inspection figure (e.g. if the pen 41 draws using the first type ink or draws using the second type ink; and in cases where the pen 41 draws using the second type ink, the color and the like the pen 41 is capable of drawing).

Note that the types of the pens 41 that the drawing tool determination portion 813 determines are not limited to colors; and for example, may determine types of the pens 41 on the basis of the thickness of the lines the pen 41 draws or the like.

In a case where, for example, the nail design (specific design image) selected to be drawn on the nail T is drawn using red ink, pink ink, and a top coat colorless ink, in which the design calls for drawing using the red ink or the pink ink to be applied first and application of the colorless ink to be performed last, the drawing tool determination portion 813 analyzes the image of the subject image Ta and, as a result thereof, in cases where it is determined that the ink applied by the pen 41 is a light-blue ink, the drawing tool determination portion 813 determines that the type of the pen 41 held in the pen holder 42 is not suitable (that is, it is not the type required to draw the specific design image).

Furthermore, the drawing tool determination portion 813 determines whether the pen 41 held in pen holder 42 is suitable for the order of the drawing to be applied by the drawing head 43.

That is, as previously, in a case where, for example, the nail design selected to be drawn on the nail T is drawn in a drawing order which calls for drawing using the red ink or the pink ink to be applied first and application of the colorless ink to be performed last, in a case where the pen 41 that draws using the colorless ink is held in the pen holder 42 prior to the drawing head 43 applying the drawing using the red or pink ink, and the pen 41 that draws using the red or pink ink is not held, the drawing tool determination portion 813 determines that the type of the pen 41 held in the pen holder 42 is not suitable.

Note that in cases where the drawing tool determination portion 813 determines that the type of the pen 41 mounted in the pen holder 42 is not suitable, indication or the like thereof is preferably displayed on the display unit 26.

The drawing position correction portion 814 determines whether or not the drawing position of the drawing tool, namely the pen 41, is deviated from the intended drawing position (legitimate drawing position) on the basis of the subject image Ta imaged by the imaging unit 50.

Moreover, in cases where it is determined that the drawing position is deviated from the legitimate drawing position, the drawing position correction portion 814 calculates a correction value for correcting the drawing position to the legitimate drawing position.

The calculated correction value is sent to the drawing data generation portion 815.

The drawing data generation portion 815 performs correction of the image data using the correction value.

FIG. 3C is an explanatory drawing illustrating an example of positional deviation of the pen 41.

In FIG. 3C, the solid lines and dashed lines shown as bold lines represent examples of images of the inspection figures (the subject images) actually drawn by the pen 41 on the drawing media 61*a* mounted on the test drawing portion 61.

The solid lines and dashed lines shown as thin lines represent the intended drawing positions (legitimate drawing positions) of the inspection figures when drawn by the pen 41. These thin lines are not actually drawn on the drawing media 61*a*, but rather are imaginary, generated through data processing in the drawing position correction portion 814. In FIG. 3C, for the sake of convenience of explanation, images of the inspection figure actually drawn by the pen 41, which are represented by bold lines, and the inspection figures at the legitimate drawing positions, which are represented by thin lines, are shown together.

In the case of the + subject image on the upper left of the example illustrated in FIG. 3C, the drawing position by the pen 41 is displaced −1 dot in the X direction and −1 dot in the Y direction from the intended legitimate drawing position (X1=−1, Y1=−1).

In this case, the drawing position correction portion 814 calculates the correction value so that when drawing, the drawing position by the pen 41 is offset exactly an amount required to compensate for the amount of deviation (that is, offset the drawing position exactly +1 dot in the X direction and +1 dot in the Y direction).

In the case of the + subject image on the upper right of the example illustrated in FIG. 3C, the drawing position by the pen 41 is displaced +1 dot in the X direction and is not displaced in the Y direction from the intended legitimate drawing position (X2=+1, Y2=0).

In this case, the drawing position correction portion 814 calculates the correction value so that when drawing, the drawing position by the pen 41 is offset exactly an amount required to compensate for the amount of deviation in only the X direction (that is, offset the drawing position −1 dot in the X direction).

In the case of the + subject image on the lower left of the example illustrated in FIG. 3C, the drawing position by the pen 41 is not displaced in the X direction and is displaced −2 dots in the Y direction from the intended legitimate drawing position (X3=0, Y3=−2).

In this case, the drawing position correction portion 814 calculates the correction value so that when drawing, the drawing position by the pen 41 is offset exactly an amount required to compensate for the amount of deviation in only the Y direction (that is, offset the drawing position +2 dots in the Y direction).

In the case of the + subject image on the lower right of the example illustrated in FIG. 3C, the drawing position by the pen 41 is displaced 1 dot in the X direction and 1 dot in the Y direction from the intended legitimate drawing position (X4=1, Y4=1).

In this case, the drawing position correction portion 814 calculates the correction value so that when drawing, the drawing position by the pen 41 is offset exactly an amount required to compensate for the amount of deviation (that is, offset the drawing position −1 dot in the X direction and −1 dot in the Y direction).

Note that in cases where the pen tip 413 of the pen 41 is comparatively thick and the lines of the drawn inspection figure are comparatively thick, the drawing position correction portion 814 performs line thinning processing in which centers of the lines are extracted. Then, the amount of deviation is detected using the center positions of the lines as reference points and the correction values are calculated.

The drawing data generation portion 815 generates data for the drawing to be applied by the drawing head 43 on the nail T of the print finger U1 on the basis of the nail information detected by the nail information detection portion 812.

Specifically, the drawing data generation portion 815 performs calibration processing, such as enlarging, reducing, and cropping of the image data of the nail design, based on the shape of the nail T and the like detected by the nail information detection portion 812, and generates data for applying the drawing on the nail T.

In the present embodiment, the drawing data generation portion 815 calibrates the image data of the nail design to the shape of the nail T corresponding to the nail information detected by the nail information detection portion 812, and performs appropriate curve correction and the like.

Furthermore, in cases where the correction value for the drawing position by the pen 41 is calculated by the drawing position correction portion 814, this correction value is applied to the image data.

As a result, drawing data for the nail design to be drawn by the pen 41 or the ink jet drawing portion 71 is generated.

The display control portion 816 is configured to cause the display unit 26 to display various display screens by controlling the display unit 26.

In the present embodiment, examples of the various display screens the display control portion 816 is configured to display on the display unit 26 include nail design selection screens and thumbnail images for confirming designs, finger images acquired by imaging the print finger U1, various command screens, and the like.

In the present embodiment, in cases where the drawing tool determination portion 813 determines that the pen 41 mounted in the pen holder 42 is not suitable for the drawing of the selected nail design, or in cases where the pen 41 mounted in the pen holder 42 is not suitable for the drawing order to be applied, the display control portion 816 causes indication thereof to be displayed on the display unit 26 and alert the user. In this case, the display unit 26 functions as alerting means.

Here, the display control portion 816 may generate a finished image of the nail design for a case where the drawing of the selected nail design is applied with the current pen 41 and display this image on the display unit 26. In this case, the display unit 26 functions as image display means.

That is, for example, in a case where there are parts of the selected nail design where pink ink is intended to be applied, but there is no pen 41 that draws using pink ink, the display control portion 816 generates a finished image of a case where the ink drawable by the pen 41 currently mounted in the pen holder 42 (for example, light-blue ink) is applied to the parts of the selected nail design where pink ink is intended, and displays this image on the display unit 26.

Additionally, here, a message asking the user to confirm whether or not to start drawing processing as-is, or the like, may also be displayed.

Furthermore, in cases where the drawing tool determination portion 813 determines that the pen 41 mounted in the pen holder 42 is not suitable for the selected nail design, the display control portion 816 may be configured to extract nail designs that can be suitably drawn using the type of the pen 41 currently mounted in the pen holder 42 as proposals of nail designs to be drawn on the nail T, and display these proposals on the display unit 26.

The drawing control portion 817 is configured to output control signals to the drawing unit 40 on the basis of the drawing data generated by the drawing data generation portion 815, and control the ink jet drawing portion 71, the pen vertical motor 426, the X-direction movement motor 46, and the Y-direction movement motor 48 of the drawing unit 40 so as to apply a drawing corresponding to the drawing data on the nail T.

In the present embodiment, the drawing control portion 817 applies test drawing and warm-up drawing of the pen 41 in the test drawing portion 61 when the pen 41 has been replaced, in cases where the apparatus has not been used for a period of time, and the like.

The timing at which the test drawing and the warm-up drawing are applied is not particularly limited. However, the test drawing and the warm-up drawing are preferably applied prior to beginning drawing operations and, particularly, the warm-up drawing is preferably applied as close to the beginning of, but prior to, drawing operations.

Next, operation and use methods of the nail printing apparatus 1 of the present embodiment are described.

Note that in the following, a description will be given of a method for controlling drawing centered on a case where the drawing is applied by the pen 41.

In cases where drawing using the nail printing apparatus 1, a user first operates a power switch to turn on the control device 80 (step S1).

The display control portion 816 displays a design selection screen on the display unit 26 (step S2).

The user operates operation buttons or the like on the operation unit 25 and selects a nail design (specific design image) to draw on the nail T from among a plurality of nail designs displayed on the design selection screen.

As a result, a selection command signal is output from the operation unit 25 and the nail design intended to be drawn on the nail T is selected (step S3).

Upon selection of the nail design, the control unit 81 displays a command screen on the display unit 26 prompting that the pen 41 required to draw the selected nail design be set in the pen holder 42 of the drawing head 43 (step S4).

The user sets the pen 41 and, upon completion thereof, operates a pen setting completion button from among the operation buttons of the operation unit 25. As a result, a setting completion signal is output from the operation unit 25.

The control unit 81 determines whether or not the setting completion signal has been output (step S5) and, in cases where the signal has not been output (NO in step S5), repeats this determination.

On the other hand, in cases where the setting completion signal has been output (YES in step S5), the drawing control portion 817 causes the drawing unit 40 to move to the test drawing portion 61 prior to beginning drawing on the nail T. Moreover, the drawing control portion 817 causes the pen vertical motor 426 of the pen holder 42 holding the pen 41 to drive and press the pen 41 down to a state where drawing can be applied.

Then, warm-up drawing is applied in which a predetermined figure such as a ○ or ∞ is drawn on the drawing media 61*a* (step S6).

Next, the drawing control portion 817 applies test drawing in which a predetermined inspection figure such as a + or similar figure is drawn at an area on the drawing media 61*a* of the test drawing portion 61 where drawing has not been applied (step S7).

Then, the control unit 81 determines whether or not the pen 41 set in the pen holder 42 is the pen 41 that draws using the second type ink (not a colorless ink and not the specific color ink) (step S8).

Specifically, for example, if the pen 41 prompted to be set in the pen holder 42 in step S4 is the pen 41 that draws using the second type ink, the control unit 81 determines that the pen 41 that draws using the second type ink is set.

Moreover, in cases where the control unit 81 determines that the pen 41 that draws using the second type ink is set (YES in step S8), the imaging control portion 811 causes the imaging unit 50 to operate and perform imaging using the diffused reflection light R2, thereby acquiring the subject image Ta (step S9).

That is, the imaging device 51 of the imaging unit 50 is caused to move to above the area where the test drawing by the pen 41 was applied.

Then, the first light source 52*a* for producing the diffused reflection light R2 is lit and the test-drawn inspection figure ta (that is, the + or similar figure) is illuminated.

Then, the imaging control portion 811 causes the imaging unit 50 to perform imaging in this state and acquire the subject image Ta.

On the other hand, in cases where the control unit 81 determines that the pen 41 that draws using the first type ink (colorless ink or the specific color ink) is set (NO in step S8), the imaging control portion 811 causes the imaging unit 50 to operate and perform imaging using the specular reflection light R1, thereby acquiring the subject image Ta (step S10).

That is, the imaging device 51 of the imaging unit 50 is caused to move to a position above the area where the test drawing was applied, and where the specular reflection light R1 enters the imaging device 51 when the light from the second light source 52*b* is radiated on the test-drawn inspection figure ta (that is, the + or similar figure).

Then, the second light source 52*b* for producing the specular reflection light R1 is lit and the inspection figure to (that is, the + or similar figure) is illuminated.

Then, the imaging control portion 811 causes the imaging unit 50 to perform imaging in this state and acquire the subject image Ta.

The subject image Ta imaged by the imaging unit 50 is sent to the drawing tool determination portion 813.

The drawing tool determination portion 813 analyzes the image in the portion of the subject image Ta where the pen 41 mounted in the pen holder 42 was expected to draw (step S11).

In cases where there is no drawing in the portion, the drawing tool determination portion 813 determines that the pen 41 is not mounted in the pen holder 42 or that the pen 41 is in a state where drawing is not possible due to a reason such as the pen 41 is out of ink or ink is not dispensing even though the pen 41 is mounted in the pen holder 42, or the like.

Note that in cases where the pen 41 that draws using the second type ink is expected to be set (YES in step S8), it will be impossible to acquire the subject image Ta by imaging using the diffused reflection light R2 in cases where the user has set the pen 41 that draws using the first type ink. In such cases as well, the drawing tool determination portion 813 determines that the pen 41 is not mounted or that the pen 41 is in a state where drawing is not possible.

In cases where the + or similar inspection figure is detected to be drawn in the portion where drawing by the pen 41 is expected from the subject image Ta, the drawing tool determination portion 813 determines the type of the pen 41 on the basis of the color or the like of the inspection figure (step S12).

Then, the drawing tool determination portion 813 determines whether or not the pen 41 mounted in the pen holder 42 is suitable for applying the drawing on the nail T. Specifically, the drawing tool determination portion 813 determines whether or not the pen 41 mounted in the pen holder 42 is the pen 41 required for the drawing of the selected nail design, and is the pen 41 suitable for the order of the drawing to be applied (step S13).

In cases where the drawing tool determination portion 813 determines that the pen 41 mounted in the pen holder 42 is not a suitable pen 41 (NO in step S13), the display control portion 816 controls the display unit 26 and prompts the user to confirm whether or not to continue the drawing processing by: (1) displaying an alert screen alerting a user to this fact, (2) displaying an image of a case where the drawing is applied with the current pen 41, (3) extracting nail designs that can be suitably drawn using the type of the pen 41 currently mounted in the pen holder 42 and displaying these nail designs as proposals to be drawn on the nail T, or the like (step S14).

In cases where continuing the drawing using the current pen 41, the user inputs a command from the operation unit 25 or the like for continuing the drawing processing.

The control unit 81 determines whether or not the command for continuing the drawing processing has been input (step S15).

Moreover, in cases where the command for continuing the drawing processing has not been input or in cases where a command for canceling the drawing processing has been input (NO in step S15), the control unit 81 cancels the drawing processing.

In this case, the user operates the drawing start button again after replacing the pen 41 mounted in the pen holder 42 with the pen 41 suitable for the selected nail design or the drawing order.

As a result, the drawing processing begins again from step S1.

On the other hand, in cases where the pen 41 mounted in the pen holder 42 is determined to be suitable for applying drawing of the selected nail design on the nail T (YES in step S13), and in cases where the command for continuing the drawing processing using the current pen 41 is input (YES in step S15), the drawing position correction portion 814 determines from the subject image Ta whether or not the position where the + or similar inspection figure has been drawn is displaced from the intended drawing position of the inspection figure (step S16).

Then, in cases where the drawing position of the inspection figure is displaced from the intended drawing position (YES in step S16), the drawing position correction portion 814 calculates the correction value required to correct this deviation (step S17).

Next, the user operates a finger securing completion switch after inserting the print finger U1 into the finger receiving portion 31, inserting the non-print fingers U2 into the finger clearing portion 32, and securing the print finger U1 to the finger receiving portion 31.

For example, in cases where the ring finger of the left hand is inserted into the finger receiving portion 31 as the print finger U1, the other fingers are inserted into the finger clearing portion 32 as the non-print fingers U2.

Upon operation of the finger securing completion switch and input of a signal indicating completion of the setting of the print finger U1 (step S18) and prior to beginning the drawing operation, the imaging control portion 811 controls the imaging unit 50 and causes the imaging device 51 to image the print finger U1 while illuminating the print finger U1 using the illumination device 52.

As a result, the imaging control portion 811, for example, acquires two images of the print finger U1 that has been inserted into the finger receiving portion 31 (step S19).

Next, the nail information detection portion 812 detects the nail information such as the outline (nail shape) of the nail T, the height of the nail T, and the inclination angle (nail curvature) on the basis of the acquired finger images (step S20).

Upon detection of the outline (nail shape) of the nail T, the inclination angle (nail curvature) of the nail T, and the like by the nail information detection portion 812, the drawing data generation portion 815 performs calibration processing of the image data of the nail design to the nail T, based on the nail information (step S21).

Then, the drawing data generation portion 815 performs correction of the image data (step S22).

Specifically, the drawing data generation portion 815 performs curvature correction on the image data of the nail design, based on the nail information.

Furthermore, in cases where the correction value is calculated by the drawing position correction portion 814, this correction value is applied to the image data. As a result, the drawing data (drawing data for drawing) is generated.

Upon generation of the drawing data, the drawing control portion 817 outputs a control signal based on the drawing data to the drawing unit 40 and causes the drawing head 43 to apply drawing based on the drawing data (step S23).

Specifically, the drawing control portion 817 causes the head movement portion 49 to operate and the drawing head 43 to appropriately move in the XY directions to the drawing position (above the nail T).

Moreover, the drawing control portion 817 confirms the height of the contact position where the pen tip 413 contacts the nail T on the basis of the distribution within the outline of the nail T of the height of the nail T in the nail information, and causes the pen vertical motor 426 to drive the number of steps corresponding to that height.

As a result, the pen 41 is pressed downward and the pen tip 413 of the pen 41 is pressed against the surface of the nail T.

As this time, a suitable degree of pressing force is applied downward via the plate spring 429, and the pen tip 413 applies drawing on the surface of the nail T while moving vertically along with the surface shape of the nail T.

Note that in cases where applying a drawing on the nails T of a plurality of fingers, after the completion of the drawing processing for the nail T of one of the fingers, the finger of the nail T for which drawing processing is completed is removed from the finger receiving portion 31.

Then, the next finger of the nail T on which drawing is to be applied is inserted into the finger receiving portion 31 as the print finger U1, the finger image of the nail T is acquired, and the processing described above is repeated.

Note that in cases where replacing the pen 41 or the ink jet drawing portion 71, the drawing control portion 817 causes the drawing head 43 to move to a position corresponding to the cover 23.

In this state, the user can remove and replace the pen 41 or the ink jet drawing portion 71 by opening the cover 23.

As described above, according to the present embodiment, determination as to whether the drawing position by the pen 41 is deviated from the legitimate drawing position is performed on the basis of the subject image Ta, which is an image of the inspection figure ta that is drawn in the test drawing portion 61.

Moreover, in cases where it is determined that there is a deviation in the drawing position, calculation of a correction value to correct this deviation is performed. Thus, there is no need to mount a separate member or mechanism for determining the deviation of the drawing position.

Additionally, in cases where there is a deviation in the drawing position, correction based on the calculated correction value is performed and, thereby, drawing can be performed at an appropriate drawing position. As a result, deviation-free highly accurate drawing can be realized through a simple and inexpensive method, without providing a mechanical mechanism on the apparatus side for preventing positional deviation.

Additionally, for the pen 41 that draws using ink that is not a colorless ink and not the specific color ink, namely the second type ink, the subject image Ta is acquired by imaging by the imaging device 51 using the diffused reflection light R2; and for the pen 41 that draws using colorless ink or the specific ink, namely the first type ink, the subject image Ta is acquired by imaging by the imaging device 51 using the specular reflection light R1.

Thus, the imaging using the diffused reflection light R2 and imaging using the specular reflection light R1 is selectively used depending on the type of ink that the pen 41 draws with. As a result, the subject image Ta can be acquired not only when the inspection figure ta is drawn using ink that is not the specific ink and not a colorless ink, namely the second type ink, but also in cases where it is difficult to capture an image using the diffused reflection light R2 such as when the inspection figure ta is drawn on paper or the like (the drawing media 61*a*) using a colorless ink, or the specific color ink, namely the first type ink.

Therefore, it can be accurately determined whether or not there is deviation in the drawing position, even when the pen 41 is used that draws using the first type ink.

As a result, highly accurate drawing can be applied in which there is an undrawn area, over-running, or the like, even for under coats, top coats, or the like drawn using the first type ink.

In the present embodiment, the type of the pen 41 mounted in the pen holder 42 is determined by analyzing the subject image Ta, which is an image of the inspection figure drawn in the test drawing portion 61 acquired by the imaging device 51.

Therefore, the type of the pen 41 can be automatically determined on the apparatus side without management by the user.

The determination of the type of the pen 41 is performed by imaging the test-drawn + or similar figure (the inspection figure ta) and performing an image analysis thereon. Therefore, separate sensors or the like for determining the type of the pen 41 are unnecessary, the apparatus configuration can be simplified, and apparatus costs can be kept low.

Furthermore, there is no need to affix an identification barcode or the like on a side of the pen 41 in order to determine the type of the pen 41. Therefore, increases in manufacturing costs incurred by the affixing of the identification barcode to the pen 41 can be avoided.

Note that the embodiments to which the present invention can be applied are not limited to the aforementioned embodiment and many variations and modifications may be made without departing from the scope of the present invention.

For example, in the embodiment described above, an example is given of a case where one pen holder 42 that holds one pen 41 is provided and a user manually replaces the pen 41 as necessary. However, the method of replacing the pen 41 is not limited thereto.

For example, a mechanism may be provided for automatically replacing the pen 41 mounted in the drawing head 43. For example, a configuration is possible in which a plurality of the pens 41 is kept in a waiting space provided near the home position, or the like, and the pen 41 is automatically selected therefrom and mounted in the drawing head 43. In such a configuration, the pen 41 can be replaced without burdening the user and drawing using a plurality of types of the pens 41 can easily be performed.

In the embodiment described above, an example is given in which the drawing head 43 is provided with one pen holder 42 that holds one pen 41. However, the pen holder 42 provided on the drawing head 43 is not limited to one, and a configuration is possible in which two or more of the pen holders 42 are provided.

Figure 8:
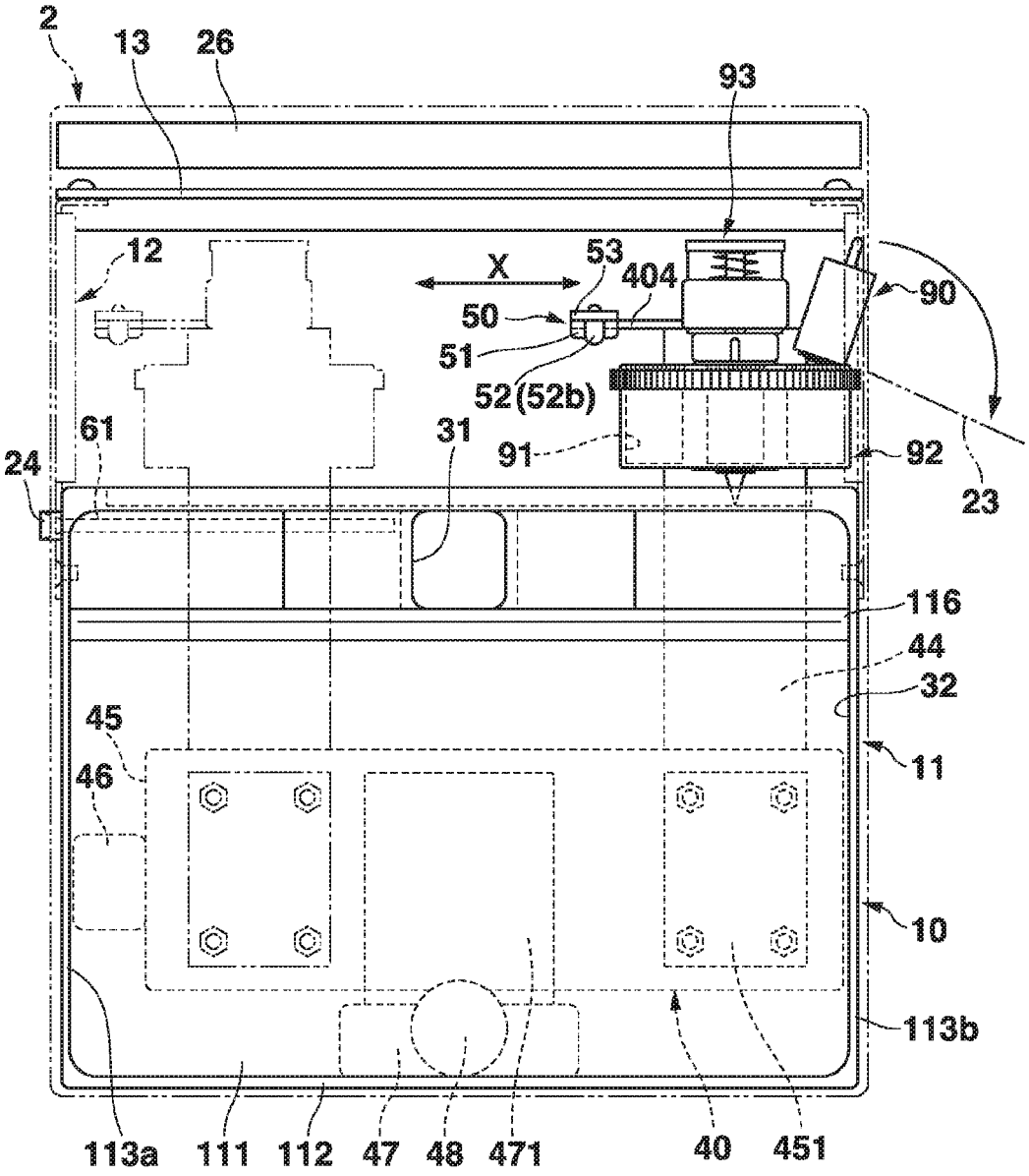
FIG. 8 is a front view of a variation of a nail printing apparatus.

For example, as illustrated in FIG. 8, the drawing head may be a rotating drawing head 92 that is provided with a plurality of pen holders 91, each storing one pen 90.

In this case, a configuration is possible in which, for example, a solenoid 93 capable of pressing the pen 90 down is provided on the drawing head 92, and, in addition to the pen 90 being pressed down by the solenoid 93, the pen 90 moves vertically via the repulsive force of a spring (not illustrated in the drawings) provided within the pen 90, or the like.

Note that as illustrated in FIG. 8, in cases where the drawing head 92 is provided with the plurality of pen holders 91 and is capable of holding the plurality of the pens 90, the drawing head 92 draws a plurality of the inspection figures ta (that is, + or similar figures) on the drawing media 61*a* by sequentially applying test drawing using the plurality of pens 90 mounted in the plurality of pen holders 91. Moreover, the imaging control portion 811 is preferably configured to cause the imaging device 51 to image the plurality of inspection figures ta at one time and acquire a plurality of the subject images Ta at one time, as such a configuration is very efficient.

Note that in cases where both the pens 41 that draw using the first type ink and the pens 41 that draw using the second type ink are mounted in the plurality of pen holders 91, the imaging using the diffused reflection light R2 to acquire the subject image Ta of the inspection figure ta drawn using the second type ink and the imaging using the specular reflection light R1 to acquire the subject image Ta of the inspection figure ta drawn using the first type ink are each performed one time.

Additionally, it is not required that all of the inspection figures ta be captured in a single image. For example, a configuration is possible in which drawing is sequentially performed of the inspection figure ta by each of the plurality of pens 90 mounted in each of the pen holders 91, imaging is performed for each instance of drawing, and a plurality of subject images Ta is acquired.

In cases where the drawing head is provided with the plurality of pen holders, upon identification of the type of the pen from the subject image Ta by the drawing tool determination portion 813, the type of pen is associated with the pen holder (position or the like of the pen holder) and stored in the memory unit 82, or the like.

When determining whether or not the pen 41 is suitable for drawing the selected nail design, the drawing tool determination portion 813 performs determination for the pens held in all the pen holders provided in the drawing head. Moreover, if all of the pens required to draw the selected nail design are mounted in any of the pen holders, even if other pens are mixed therein, the drawing tool determination portion 813 determines that the pens are a match for the drawing of the selected nail design.

The present embodiment is configured to determine that a pen is not suitable to apply the drawing in cases where a pen unsuitable for the order of drawing is mounted. However, if the drawing head is provided with the plurality of pen holders and all of the pens required to draw the selected nail design are mounted in any of the pen holders, the order of drawing can be controlled by the drawing control portion 817. Therefore, in this case, the drawing tool determination portion 813 determines that the pens are a match for the drawing of the selected nail design.

In the present embodiment, examples have been given of a case in which the drawing head 43 is provided with the pen 41 that applies drawing using the second type ink and the pen 41 that applies drawing using the first type ink that is colorless ink or the specific color ink, for example a white ink. However, both of these pens 41 need not be provided. For example, the present invention may be applied to a dedicated apparatus for applying under coats and/or top coats, in which only the pen 41 that applies drawing using the first type ink is provided.

In this case, when imaging the inspection figure ta, the subject image Ta is acquired by illuminating the inspection figure ta using the illumination device 52 for constantly producing the specular reflection light R1, and capturing, with the imaging device 51, the specular reflection light R1 that has specularly reflected from the inspection figure ta drawn using the first type ink, which is in a wet state.

Even in this case, the subject image Ta of the inspection figure ta drawn on the drawing media 61*a*, which cannot be captured using the diffused reflection light R2, can be captured, and deviations in the drawing position by the pen 41 that draws using the first type that is colorless ink or the specific color ink can be accurately detected.

In the present embodiment, a configuration is described in which the pen 41 is pressed down by using the pen vertical motor 426 to operate the plate spring 429. However, the configuration of vertically moving the pen 41 is not limited thereto.

Furthermore, in the embodiment described above, an example has been given of a case in which the imaging unit 50 provided with the imaging device 51 and the illumination device 52 is disposed and fixed on the side of the drawing head 43 and moves along with the drawing head 43. However, the present invention is not limited to the configuration in which the imaging unit is fixed to the drawing head 43.

For example, a movement mechanism for moving the imaging unit may be provided separately from the mechanism for moving the drawing head 43.

In the embodiment described above, an example has been given of a case where the configuration of the present invention is applied to an ink jet printing/plotter printing hybrid type nail printing apparatus 1 provided with both the pen 41 and the ink jet drawing portion 71. However, the nail printing apparatuses to which the configuration of the present invention can be applied are not limited thereto.

For example, the configuration of the present invention can be applied to a nail printing apparatus provided with a plotter-type drawing head 43 having only the pen 41.

In the present embodiment, an example has been given of a case in which the warm-up drawing and the test drawing are separated and applied independently. However, the figure drawn as the warm-up drawing may be imaged and used in the determination of the type of the drawing tool, the determination of the drawing position, the calculation of the correction value, and the like.

In this case, a + or similar figure is drawn as the warm-up drawing. By extending each line a certain amount, even if some fading occurs at the start of drawing, drawing of the figure is possible.

In this case, the warm-up drawing and the test drawing can be applied in one time, time can be saved, and reduction of the consumption of ink can be maximized.

In the present embodiment, the determination of the type of the drawing tool, namely the pen 41, the determination of the drawing position, and the calculation of the correction value are performed on the basis of the subject image, acquired by imaging the inspection figure drawn in the test drawing. However, a configuration is possible in which the determination of the type of the drawing tool, namely the pen 41, the determination of the drawing position, and the calculation of the correction value are each performed on the basis of separate images. In this case, a more accurate determination is possible due to images more suited to each of the determination being drawn.

In the present embodiment, the determination of the type of the drawing tool, namely the pen 41 and the determination of the drawing position, and the calculation of the correction value are both performed. However, it is not necessary to perform both, and a configuration is possible in which only one is performed.

In the embodiment described above, an example has been given of a case in which a piece of paper, namely the drawing media, is used for the warm-up drawing and the test drawing of the drawing tool, namely the pen 41. However, the drawing media is not limited to paper. Provided that drawing by the pen 41 is possible, any material may be used.

A roll of media may also be used as the drawing media. In this case, a media feed mechanism that feeds and takes up the drawing media automatically or manually is provided.

In cases where the drawing media is a roll of media, a media mounting port for mounting the roll of drawing media is provided in place of the media access port 24.

Note that in this case as well, media that diffusely reflects light is used as the drawing media. Thereby, sufficient contrast can be obtained between the drawing media and the inspection figure to drawn using the first type ink which, in a wet state, can be captured by specular reflection light R1.

In the embodiment described above, an example has been given of a case in which the drawing data generation portion 815 performs the curvature correction on the image data of the nail design and generates the drawing data. However, the drawing data generation portion 815 generating the drawing data is not a necessary constituent of the present invention.

For example, a configuration is possible in which the image data is not generated separately. In such a configuration, drawing control may be performed in the drawing control portion 817 such that drawing complying with the nail shape is performed by appropriately converting the image data of the nail design via a lookup table (LUT) or the like while outputting the converted data to the drawing head.

In the embodiment described above, an example has been given of a case in which the shape of the nail T is detected as the nail information and the drawing data is generated on the basis thereof. However, the detection of the nail shape is not a necessary constituent of the present invention.

For example, in cases where it is not necessary to extract the outline of the nail T on which the drawing is to be applied such as a case where a single dot is drawn at roughly the middle of the nail T, it is not necessary to precisely recognize the shape of the nail T and drawing can be applied without detecting the nail shape.

The imaging device 51 of the imaging unit is not limited to the imaging device 51 that takes still images, and may be a device capable of taking moving images. In this case, a moving image is recorded by the imaging device and an image of the top surface of the nail T is appropriately captured from the recorded moving image and used to detect the nail information.

In the embodiment described above, an example has been given of the nail printing apparatus 1 in which fingers are inserted into the apparatus one finger at a time, and drawing is applied on the nail of one finger. However, for example, the present invention can also be applied to an apparatus into which a plurality of fingers can be inserted simultaneously and printing can be applied consecutively on the nails of the plurality of inserted fingers.

For example, by broadening the operating range of the pen 41 so as to enlarge the drawable area, drawings can be continuously applied to a plurality of the print fingers U1.

The embodiments described above are not to be construed as limiting the scope of the present invention and include the scope of the invention recited in the claims and equivalents.

The invention claimed is:

1. A drawing apparatus comprising:

a drawing head on which at least one drawing tool is mounted, the drawing tool applying a drawing on a drawing subject;

an imaging unit which acquires a subject image by imaging the drawing subject; and an illumination device comprising at least one light source configured to radiate light on an area of the drawing subject where the drawing is applied; wherein the drawing tool includes a first drawing tool that applies the drawing by using a first type ink which is a colorless ink or a specific color ink which has substantially the same color as the drawing subject, and a second drawing tool that applies the drawing by using a second type ink which is not the colorless ink and not the specific color ink; and in a case where the drawing on a first drawn area of the drawing subject is applied by the first drawing tool, the imaging unit acquires the subject image by imaging the first drawn area where the light radiated from the light source is specularly reflected.

2. The drawing apparatus according to claim 1, wherein:

in a case where the drawing on the drawing subject is applied by the first drawing tool, the imaging unit acquires the subject image during a period from immediately after applying the drawing until completion of drying of the first type ink used in the drawing.

3. The drawing apparatus according to claim 1, wherein:

in a case where the drawing on a second drawn area of the drawing subject is applied by the second drawing tool, the imaging unit acquires the subject image by imaging the second drawn area where the light radiated from the light source is diffusely reflected.

4. The drawing apparatus according to claim 3, further comprising:

a movement portion configured to move a position of the imaging unit; wherein in a case where the imaging unit acquires the subject image after the drawing is applied by the second drawing tool, the movement portion causes the imaging unit to be moved to a first position where light radiated from the light source diffusely reflects at the second drawn area and enters the imaging unit, and light radiated from the light source specularly reflects at the second drawn area and does not enter the imaging unit; and in a case where the imaging unit acquires the subject image after the drawing is applied by the first drawing tool, causes the imaging unit to be moved to a second position different from the first position, where light radiated from the light source specularly reflects at the first drawn area and enters the imaging unit.

5. The drawing apparatus according to claim 4, wherein:

the light source of the illumination device is provided at a position separated a set distance from the imaging unit and moves integrally with the imaging unit.

6. The drawing apparatus according to claim 5, wherein:

the illumination device comprises, as the light source, a first light source disposed at a position where a distance from the imaging unit is a first distance, and a second light source disposed at a position, namely a second position, where a distance from the imaging unit is shorter than the first distance;

the first position is set at a position where light radiated from the first light source diffusely reflects at the second drawn position and enters the imaging unit, and light radiated from the second light source specularly reflects at the first drawn area and does not enter the imaging unit; and the second position is set at a position where light radiated from the second light source specularly reflects at the first drawn position and enters the imaging unit.

7. The drawing apparatus according to claim 1, further comprising:

a drawing position correction portion which determines from the subject image whether or not a drawing position by the drawing tool is displaced from an intended legitimate drawing position and, when it is determined that the drawing position is displaced, calculates a correction value for correcting the drawing position to the legitimate drawing position.

8. The drawing apparatus according to claim 1, further comprising:

a drawing tool determination portion which determines from the subject image whether or not at least one specific drawing tool, required for a drawing of a specific design image selected by a user as an image to be drawn by the drawing unit on a drawing subject surface different from the drawing subject, is mounted on the drawing head.

9. The drawing apparatus according to claim 8, wherein:

the drawing subject is a piece of paper; and the drawing subject surface is a surface of a nail of a finger of a hand or a surface of a nail of a toe of a foot.

10. A drawing apparatus comprising:

a drawing head on which at least one drawing tool is mounted, the drawing tool applying a drawing on a drawing subject;

an imaging unit which acquires a subject image by imaging the drawing subject; and an illumination device comprising at least one light source configured to radiate light on an area of the drawing subject where the drawing is applied; wherein the drawing tool includes at least a specific drawing tool that applies the drawing by using a specific ink which is a colorless ink or a specific color ink which has substantially the same color as the drawing subject; and in a case where the drawing on a drawn area of the drawing subject is applied by the specific drawing tool, the imaging unit acquires the subject image by imaging the drawn area where the light radiated from the light source is specularly reflected.

11. The drawing apparatus according to claim 10, wherein:

the imaging unit acquires the subject image during a period from immediately after applying the drawing by using the specific drawing tool until completion of drying of the specific ink used in the drawing.

12. A method for controlling drawing by a drawing apparatus, the drawing apparatus comprising:

a drawing head on which at least one drawing tool is mounted, the drawing tool applying a drawing on a drawing subject; an imaging unit which acquires a subject image by imaging the drawing subject; and an illumination device comprising at least one light source configured to radiate light on an area of the drawing subject where the drawing is applied; wherein the drawing tool includes a first drawing tool that applies the drawing by using a first type ink which is a colorless ink or a specific color ink which has substantially the same color as the drawing subject, and a second drawing tool that applies the drawing by using a second type ink which is not the colorless ink and not the specific color ink;

the method for controlling drawing comprising:

a step of applying the drawing on the drawing subject by using the drawing tool mounted on the drawing head; and a step of acquiring the subject image using the imaging unit by imaging the area of the drawing subject where the drawing is applied, after the drawing has been applied on the drawing subject; wherein in a case where the drawing on a first drawn area of the drawing subject is applied by the first drawing tool, the step of acquiring the subject image comprises a step of acquiring the subject image using the imaging unit by imaging the first drawn area where the light radiated from the light source is specularly reflected.

13. The method for controlling drawing by a drawing apparatus according to claim 12, wherein:

in a case where the drawing on the drawing subject is applied by the first drawing tool by using the first type ink, the step of acquiring the subject image is executed during a period from immediately after applying the drawing until completion of drying of the first type ink used in the drawing.

14. The method for controlling drawing by a drawing apparatus according to claim 12, wherein:

in a case where the drawing on a second drawn area of the drawing subject is applied by the second drawing tool, the step of acquiring the subject image comprises a step of acquiring the subject image using the imaging unit by imaging the second drawn area where the light radiated from the light source is diffusely reflected.

15. The method for controlling drawing by a drawing apparatus according to claim 14, the drawing apparatus further comprising:

a movement portion configured to move a position of the imaging unit;

the method for controlling drawing comprising:

in a case where the imaging unit acquires the subject image after the drawing has been applied by the second drawing tool, a step of moving the imaging unit to a first position where light radiated from the light source diffusely reflects at the second drawn area and enters the imaging unit, and light radiated from the light source specularly reflects at the second drawn area and does not enter the imaging unit; and in a case where the imaging unit acquires the subject image after the drawing has been applied by the first drawing tool, a step of moving the imaging unit to a second position different from the first position, where light radiated from the light source specularly reflects at the first drawn area and enters the imaging unit.

16. The method for controlling drawing by a drawing apparatus according to claim 15, wherein:

the illumination device comprises, as the light source, a first light source that moves integrally with the imaging unit and is disposed at a position where a distance from the imaging unit is a first distance, and a second light source that moves integrally with the imaging unit and is disposed at a position, namely a second position, where a distance from the imaging unit is shorter than the first distance;

the first position is set at a position where light radiated from the first light source diffusely reflects at the area of the drawing subject where the drawing is applied and enters the imaging unit, and light radiated from the first light source specularly reflects at the area of the drawing subject where the drawing is applied and does not enter the imaging unit; and the second position is set at a position where light radiated from the second light source specularly reflects at the area of the drawing subject where the drawing is applied and enters the imaging unit.

17. The method for controlling drawing by a drawing apparatus according to claim 12, the method further comprising:

a step of determining from the subject image whether or not a drawing position by the drawing tool is displaced from an intended legitimate drawing position and, when it is determined that the drawing position is displaced, calculating a correction value for correcting the drawing position to the legitimate drawing position.

18. The method for controlling drawing by a drawing apparatus according to claim 12, the method further comprising:

a step of determining from the subject image whether or not at least one specific drawing tool, required for a drawing of a specific design image selected by a user as an image to be drawn by the drawing unit on a drawing subject surface different from the drawing subject, is mounted on the drawing head.

19. A method for controlling drawing by a drawing apparatus, the drawing apparatus comprising:

a drawing head on which at least one drawing tool is mounted, the drawing tool applying a drawing on a drawing subject;

an imaging unit which acquires a subject image by imaging an area of the drawing subject where the drawing is applied; and an illumination device comprising at least one light source configured to radiate light on an area of the drawing subject where the drawing is applied; wherein the drawing tool includes at least a specific drawing tool that applies the drawing by using a specific ink which is a colorless ink or a specific color ink which has substantially the same color as the drawing subject;

the method for controlling drawing comprising:

a step of applying the drawing on a drawn area of the drawing subject by the specific drawing tool mounted on the drawing head by using the specific ink; and a step of acquiring the subject image using the imaging unit by imaging the drawn area where the light radiated from the light source is specularly reflected.

20. The method for controlling drawing by a drawing apparatus according to claim 19, wherein:

the step of acquiring the subject image by the imaging unit is executed during a period from immediately after applying the drawing by using the specific ink until completion of drying of the specific ink used in the drawing.

* * * * *